US010431402B2

(12) United States Patent
Hsieh et al.

(10) Patent No.: US 10,431,402 B2
(45) Date of Patent: Oct. 1, 2019

(54) BUTTON SWITCH WITH ADJUSTABLE TACTILE FEEDBACK

(71) Applicant: DARFON ELECTRONICS CORP., Taoyuan (TW)

(72) Inventors: Yu-Chun Hsieh, Taoyuan (TW); Chia-Hung Liu, Taoyuan (TW); Yung-Chih Wang, Taoyuan (TW); Chen Yang, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/108,070

(22) Filed: Aug. 21, 2018

(65) Prior Publication Data

US 2019/0172661 A1 Jun. 6, 2019

(30) Foreign Application Priority Data

Dec. 4, 2017 (TW) ..... 106142370 A

(51) Int. Cl.

| | |
|---|---|
| ***H01H 13/10*** | (2006.01) |
| ***H01H 13/04*** | (2006.01) |
| ***H01H 3/12*** | (2006.01) |
| *H01H 13/85* | (2006.01) |
| *H01H 13/705* | (2006.01) |

(52) U.S. Cl.

CPC ..... *H01H 13/10* (2013.01); *H01H 3/12* (2013.01); *H01H 13/04* (2013.01); *H01H 13/705* (2013.01); *H01H 13/85* (2013.01)

(58) Field of Classification Search

CPC ..... H01H 13/10; H01H 3/12; H01H 13/04; H01H 13/705; H01H 13/85

USPC ..... 200/275

See application file for complete search history.

(56) References Cited

U.S. PATENT DOCUMENTS

| | | | | |
|---|---|---|---|---|
| 4,447,681 | A * | 5/1984 | Desmarais | H01H 13/705 200/5 A |
| 5,049,709 | A * | 9/1991 | Prickett | H01H 13/585 200/253 |
| 10,079,601 | B2 * | 9/2018 | Liu | H01H 13/705 |
| 2017/0221653 | A1 * | 8/2017 | Liao | H01H 13/023 |

(Continued)

FOREIGN PATENT DOCUMENTS

| | | |
|---|---|---|
| TW | M461142 U1 | 9/2013 |
| TW | I581290 B | 5/2017 |

*Primary Examiner* — Amy Cohen Johnson
*Assistant Examiner* — Iman Malakooti
(74) *Attorney, Agent, or Firm* — Winston Hsu

(57) ABSTRACT

A button switch connected to a cap and includes a base having a pillar, a flexible acoustic member having fixing and flexible rods, a sleeve, an upward-force-applying member abutting against the sleeve and the base, a resilient arm, and a cover disposed on the base. The sleeve rotatably jackets the pillar, passes through the cover to be connected to the cap, and has first and second convex portions, first and second concave portions, and a protruding edge located between the second convex portion and the second concave portion. The resilient arm selectively abuts against a first or second position on the first convex portion. When the resilient arm abuts against the first position and the protruding edge is located above the flexible rod, the flexible rod crosses the protruding edge and then collides with the cover to make a sound when the sleeve receives an external force to move downward.

24 Claims, 27 Drawing Sheets

(56) References Cited

U.S. PATENT DOCUMENTS

2018/0006648 A1* 1/2018 Liu ..... H01H 13/705
2018/0074587 A1 3/2018 Liu

* cited by examiner

BUTTON SWITCH WITH ADJUSTABLE TACTILE FEEDBACK

BACKGROUND OF THE INVENTION

1. Field of the Invention

The present invention relates to a button switch, and more specifically, to a button switch with an adjustable tactile feedback via rotation of a sleeve relative to a base.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

In practical application, there are various kinds of keyswitches for providing different tactile feedbacks. For example, a gaming keyboard would indicates that it has red, brown or black keyswitches installed thereon on its packing box to remind the user of what kind of tactile feedback (e.g. high or low triggering position, long or short travel distance, required actuation force, tactile or linear feedback, clicky or non-clicky tactile feedback, etc.) the gaming keyboard could provide. That is to say, a conventional mechanical keyswitch could only provide one single kind of tactile feedback without a tactile feedback adjusting function. Thus, if the user wants to experience different kinds of tactile feedbacks, the user must buy a new keyboard or replace the original keyswitches on the gaming keyboard with new keyswitches for providing another kind of tactile feedback. In such a manner, it would cause a high replacement cost, so as to greatly limit flexibility in use and operational convenience of the mechanical keyswitch.

SUMMARY OF THE INVENTION

The present invention provides a button switch connected to a cap. The button switch includes abase, a cover, a flexible acoustic member, a sleeve, an upward-force-applying member and a resilient arm. The base has a pillar extending along a Z-axis. The Z-axis, an X-axis and a Y-axis are perpendicular to each other. The cover is disposed on the base. The flexible acoustic member has a fixing rod and a flexible rod. The fixing rod is fixed to the base. The sleeve rotatably jackets the pillar to be movable upward and downward between a high position and a low position along the Z-axis. The upper end of the sleeve passes through the cover to be connected to the cap. The sleeve has an outer annular surface. The outer annular surface has a first convex portion, a first concave portion, a second convex portion, a second concave portion, and a protruding edge located between the second convex portion and the second concave portion. The upward-force-applying member abuts against the sleeve and the base respectively for driving the sleeve to move away from the base. The resilient arm is adjacent to the pillar. The resilient arm selectively abuts against the first convex portion at a first position or a second position with rotation of the sleeve on the pillar around the Z-axis when the sleeve is located at the high position. The resilient arm moves to a position corresponding to the first concave portion when the sleeve is located at the low position. When the sleeve rotates to make the resilient arm abut against the first convex portion at the first position, the protruding edge is misaligned with the flexible rod and the sleeve receives an external force to move downward along the Z-axis, the flexible rod does not need to cross the protruding edge and the resilient arm moves from the first position to the position corresponding to the first concave portion with downward movement of the sleeve. When the sleeve rotates to make the resilient arm abut against the first convex portion at the second position, the protruding edge is located above the flexible rod, and the sleeve receives the external force to move downward along the Z-axis, the flexible rod needs to cross the protruding edge and the resilient arm moves from the second position to a position corresponding to the second concave portion with downward movement of the sleeve. When the sleeve moves downward along the Z-axis and deformation of the flexible rod caused by pressing of the protruding edge is not enough to make the flexible rod cross the protruding edge, the flexible rod deforms downward with the protruding edge. When deformation of the flexible rod is enough to make the flexible rod cross the protruding edge, the flexible rod is released and then moves upward to collide with the cover for making a sound. When the external force is released, the upward-force-applying member drives the sleeve to move upward relative to the pillar along the Z-axis for making the resilient arm abut against the first convex portion at the first position or the second position.

The present invention further provides a button switch connected to a cap. The button switch includes a base, a cover, a sleeve, an upward-force-applying member and a resilient arm. The base has a pillar extending along a Z-axis. The Z-axis, an X-axis and a Y-axis are perpendicular to each other. The cover is disposed on the base. The resilient arm is adjacent to the pillar. The sleeve rotatably jackets the pillar to be movable upward and downward between a high position and a low position along the Z-axis. An upper end of the sleeve passes through the cover to be connected to the cap. The sleeve has an outer annular surface. The outer annular surface has a first convex portion, a first concave portion, a second convex portion, a second concave portion, and an arc-shaped bar. The arc-shaped bar extends above the second convex portion but not extends above the first convex portion. The resilient arm selectively abuts against the first convex portion or the second convex portion when the cap is located at the high position. The upward-force-applying member abuts against the sleeve and the base respectively for driving the sleeve to move away from the base. When the resilient arm abuts against the second convex portion and the sleeve receives an external force to move downward along the Z-axis, the resilient arm needs to cross the arc-shaped bar with downward movement of the sleeve when the resilient arm moves to a position corresponding to the second concave portion. When the resilient arm abuts against the first convex portion and the sleeve receives the external force to move downward along the Z-axis, the resilient arm does not need to cross the arc-shaped bar with downward movement of the sleeve when the resilient arm moves to a position corresponding to the first concave portion. When the external force is released, the upward-force-applying member drives the sleeve to move upward relative to the pillar along the Z-axis for making the resilient arm abut against the first convex portion or the second convex portion.

The present invention further provides a button switch connected to a cap. The he button switch includes a base, a cover, a sleeve, an upward-force-applying member and a resilient arm. The base has a pillar, a top surface and a protruding block adjacent to the pillar. The pillar protrudes from the top surface along a Z-axis. The Z-axis, an X-axis and a Y-axis are perpendicular to each other. The protruding block is higher than the top surface along the Z-axis. The cover is disposed on the base. The sleeve rotatably jackets the pillar to be movable upward and downward between a high position and a low position along the Z-axis. The upper end of the sleeve passes through the cover to be connected to the cap. The sleeve has an outer annular surface. The outer annular surface has a first convex portion, a first concave portion, a second convex portion, and a second concave portion. A groove and a bottom surface are formed on a bottom end of the sleeve. The sleeve rotates on the pillar around the Z-axis to make the protruding block selectively located under the groove or the bottom surface. The upward-force-applying member abuts against the sleeve and the base respectively for driving the sleeve to move away from the base. The resilient arm is adjacent to the pillar. The resilient arm abuts against the first convex portion when the sleeve rotates around the Z-axis to make the protruding block located under the groove. The resilient arm abuts against the second convex portion when the sleeve rotates around the Z-axis to make the protruding block located under the bottom surface. When the protruding block is located under the groove and the sleeve receives an external force to move downward along the Z-axis, the resilient arm moves to a position corresponding to the first concave portion until the protruding block is contained in the groove, so that a maximum movable distance of the sleeve along the Z-axis is set as a first travel distance. When the protruding block is located under the bottom surface and the sleeve receives the external force to move downward along the Z-axis, the resilient arm moves to a position corresponding to the second concave portion until the protruding block abuts against the bottom surface, so that the maximum movable distance of the cap along the Z-axis is set as a second travel distance less than the first travel distance. When the external force is released, the upward-force-applying member drives the sleeve to move upward relative to the pillar along the Z-axis for making the resilient arm abut against the first convex portion or the second convex portion.

The present invention further provides a button switch connected to a cap. The button switch includes a base, a cover, a switch unit, a sleeve and an upward-force-applying member. The base has a pillar extending along a Z-axis. The Z-axis, an X-axis and a Y-axis are perpendicular to each other. The cover is disposed on the base. The switch unit is adjacent to the pillar. The switch unit has a resilient arm and a contact point opposite to the resilient arm. The switch unit is electrically connected to a circuit board. The sleeve rotatably jackets the pillar to be movable upward and downward between a high position and a low position along the Z-axis. An upper end of the sleeve passes through the cover to be connected to the cap. The sleeve has an outer annular surface. The outer annular surface has a first convex portion, a first concave portion, a second convex portion, a second concave portion, a first transition portion, and a second transition portion lower than the first transition portion along the Z-axis. The first convex portion, the first transition portion and the first concave portion are arranged from down to up along the Z-axis. The second convex portion, the second transition portion and the second concave portion are arranged from down to up along the Z-axis. The resilient arm selectively abuts against the first convex portion or the second convex portion when the sleeve is located at the high position. The upward-force-applying member abuts against the sleeve and the base respectively for driving the sleeve to move away from the base. When the resilient arm abuts against the first convex portion and the sleeve receives an external force to move downward along the Z-axis, the resilient arm moves to a position corresponding to the first concave portion along the first transition portion to make the resilient arm located at a first triggering position for triggering the contact point. When the resilient arm abuts against the second convex portion and the sleeve receives the external force to move downward along the Z-axis, the resilient arm moves to a position corresponding to the second concave portion along the second transition portion to make the resilient arm located at a second triggering position lower than the first triggering position along the Z-axis for triggering the contact point. When the external force is released, the upward-force-applying member drives the sleeve to move upward relative to the pillar along the Z-axis, to make the resilient arm abut against the first convex portion or the second convex portion and be separate from the contact point.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
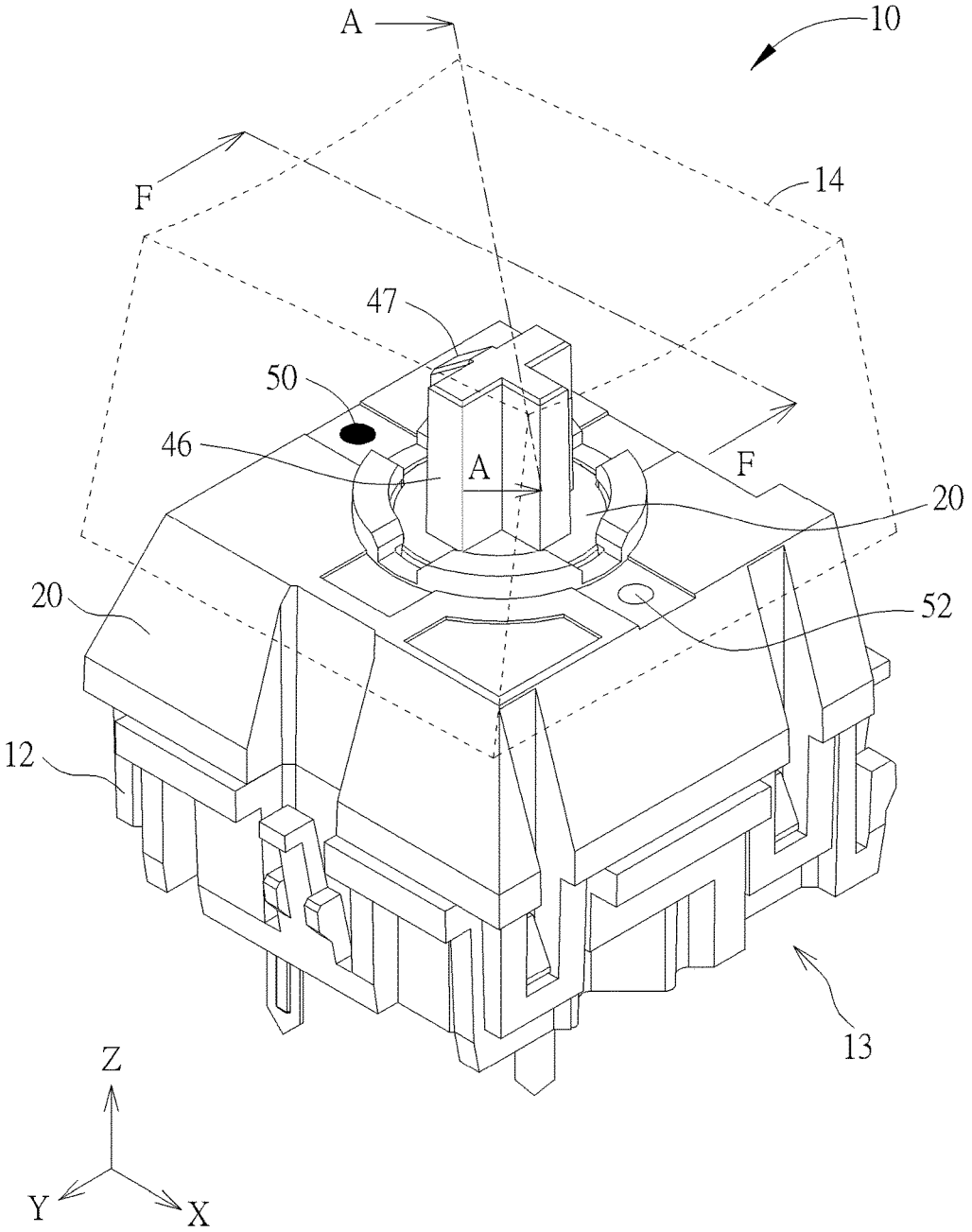
FIG. 1 is a diagram of a keyswitch according to an embodiment of the present invention.
Figure 2:
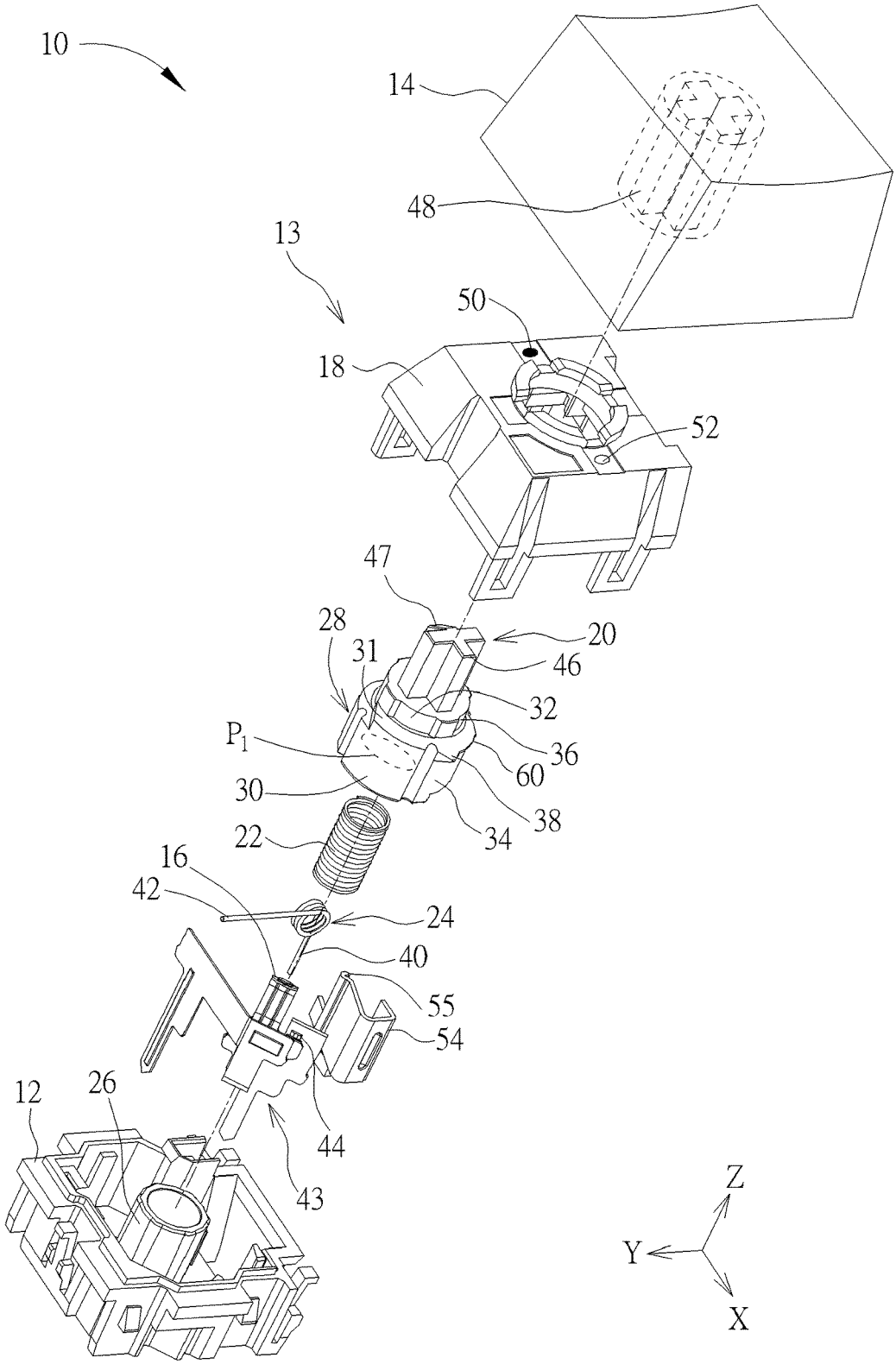
FIG. 2 is an exploded diagram of the keyswitch in FIG. 1.
Figure 3:
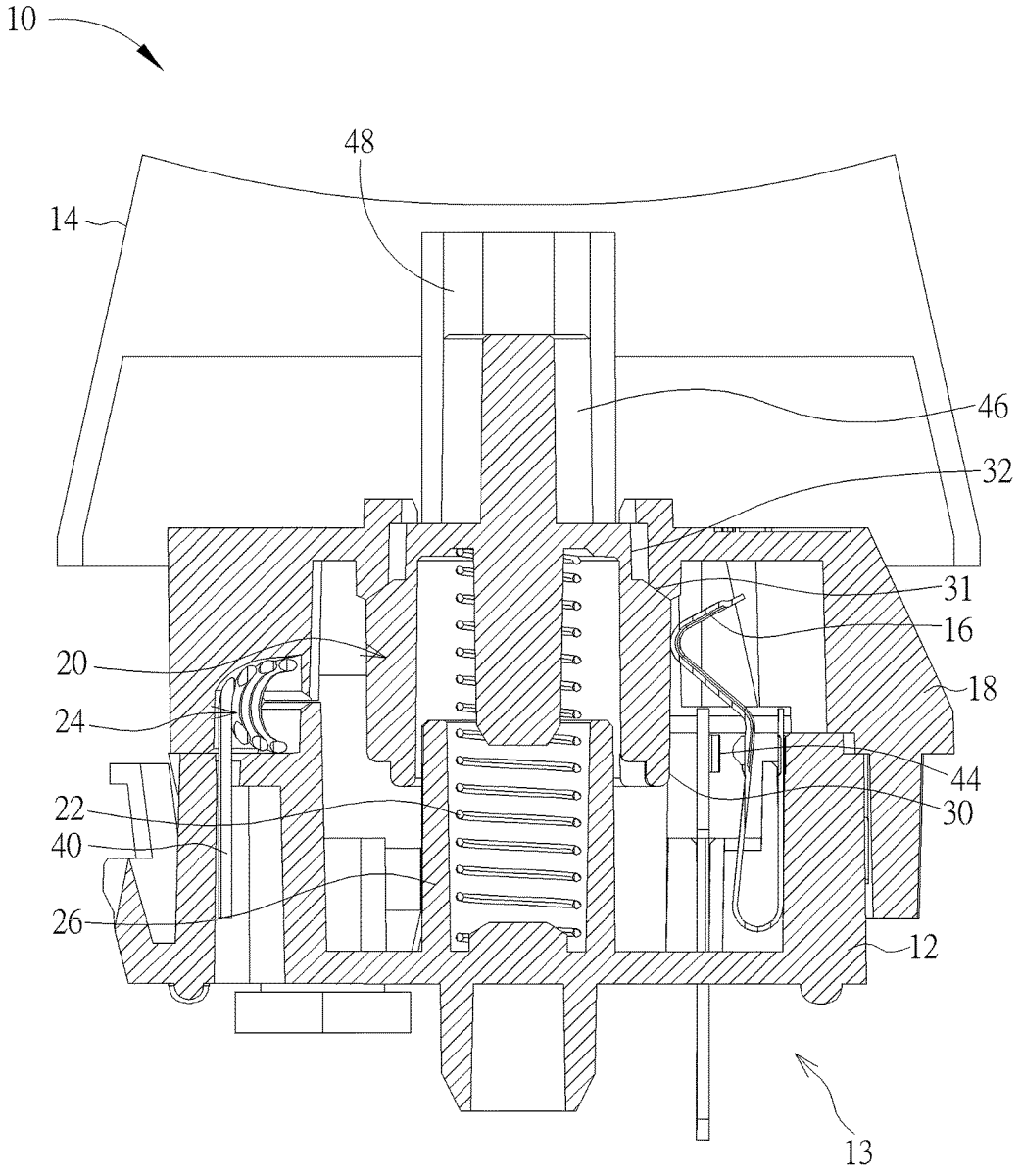
FIG. 3 is a cross-sectional diagram of the keyswitch in FIG. 1 along a cross-sectional line A-A.
Figure 4:
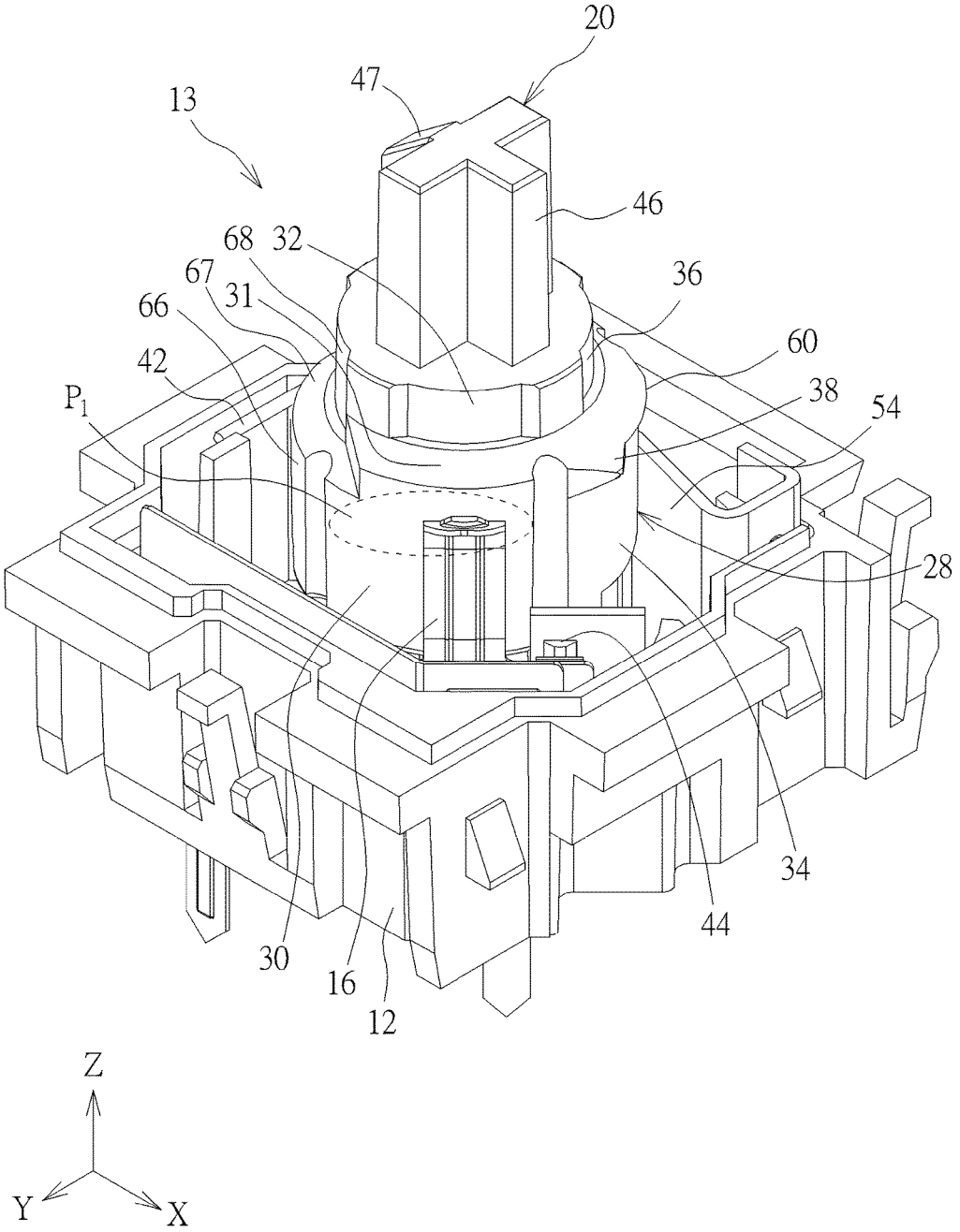
FIG. 4 is a diagram of a button switch in FIG. 1 after a cover is omitted.
Figure 5:
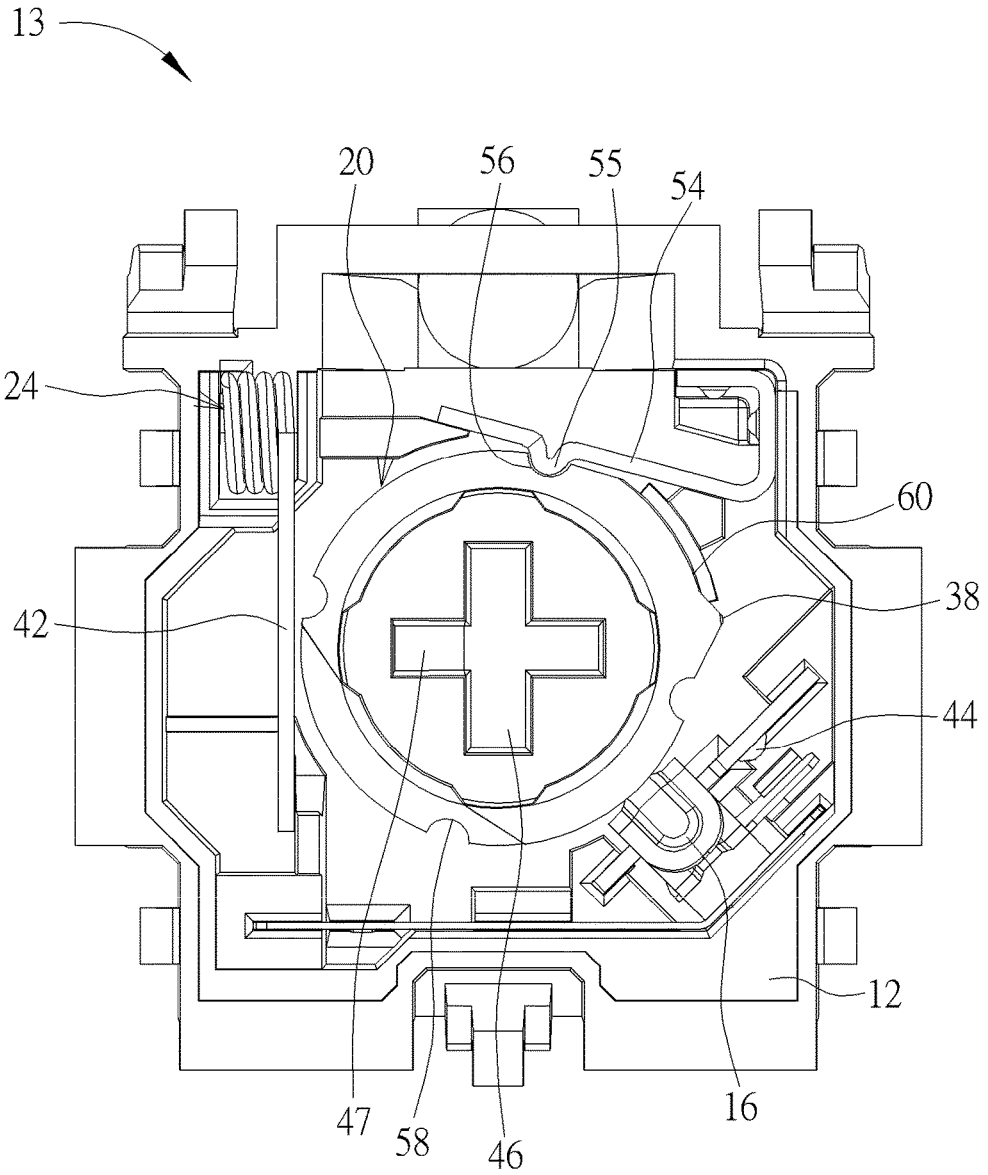
FIG. 5 is a top view of the button switch in FIG. 4.
Figure 6:
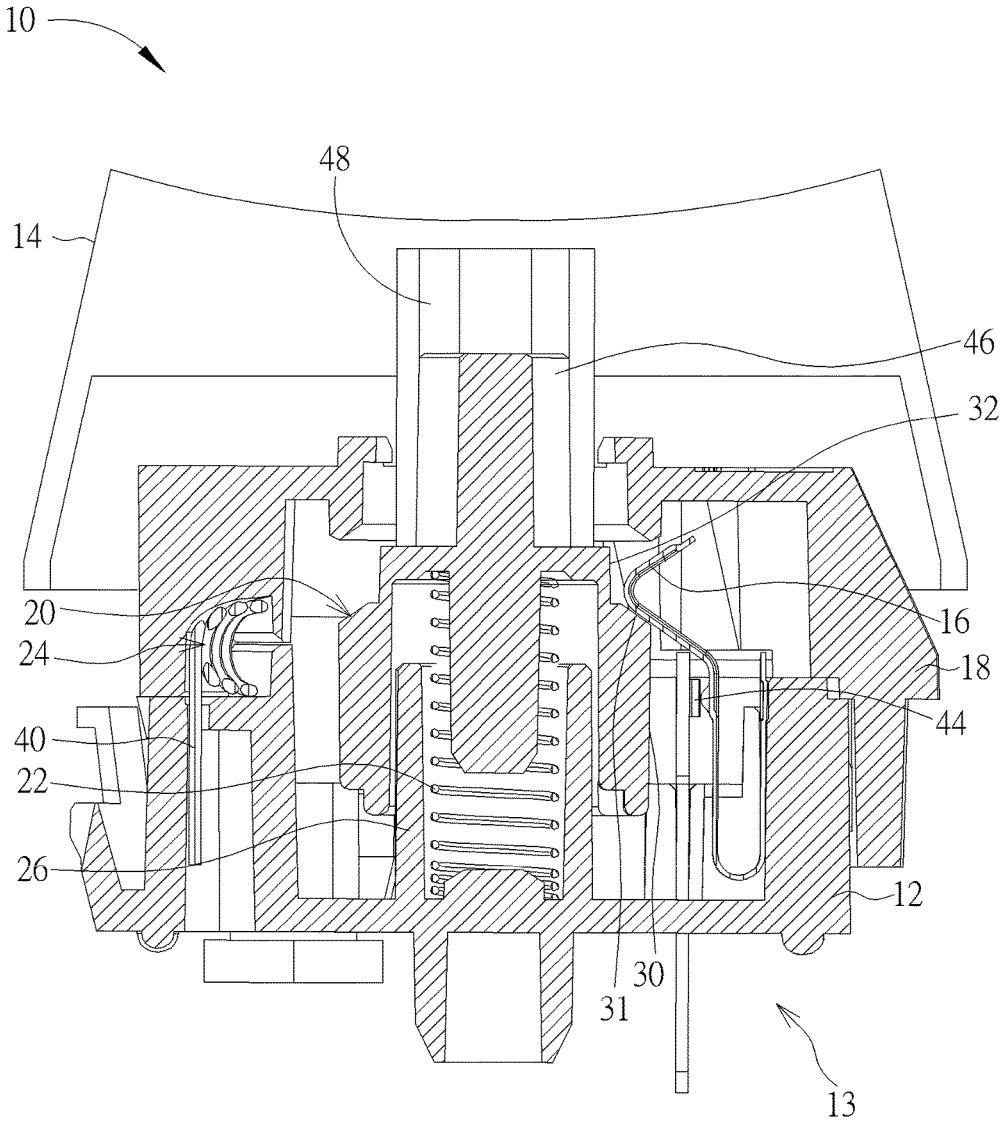
FIG. 6 is a cross-sectional diagram of a sleeve in FIG. 3 being pressed via a cap.
Figure 7:
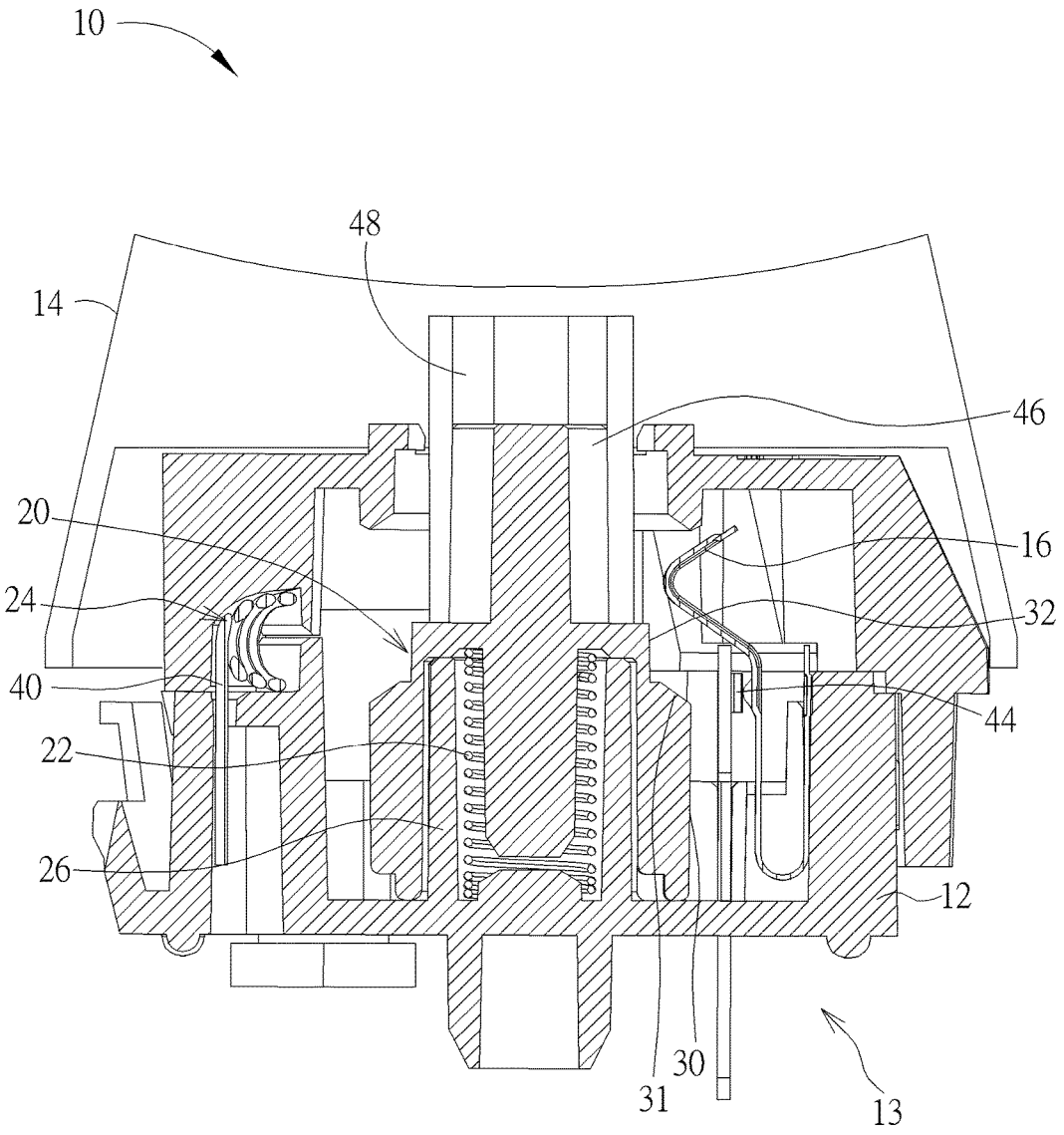
FIG. 7 is a cross-sectional diagram of the sleeve in FIG. 6 being pressed to a low position.

Please refer to FIG. 1, FIG. 2, FIG. 3, FIG. 4, FIG. 5, FIG. 6, and FIG. 7. FIG. 1 is a diagram of a keyswitch 10 according to an embodiment of the present invention. FIG. 2 is an exploded diagram of the keyswitch 10 in FIG. 1. FIG. 3 is a cross-sectional diagram of the keyswitch 10 in FIG. 1 along a cross-sectional line A-A. FIG. 4 is a diagram of a button switch 13 in FIG. 1 after a cover 18 is omitted. FIG. 5 is a top view of the button switch 13 in FIG. 4. FIG. 6 is a cross-sectional diagram of a sleeve 20 in FIG. 3 being pressed via a cap 14. FIG. 7 is a cross-sectional diagram of the sleeve 20 in FIG. 6 being pressed to a low position. The cap 14 is briefly depicted by dotted lines in FIG. 1. As shown in FIGS. 1-7, the keyswitch 10 includes the button switch 13 and the cap 14. The button switch 13 is connected to the cap 14 to construct the keyswitch 10 cooperatively with the cap 14, but not limited thereto. It means that the button switch 13 could be only used as one single switch device for a user to press in another embodiment.

The button switch 13 includes a base 12, a resilient arm 16, the cover 18, the sleeve 20, an upward-force-applying member 22, a flexible acoustic member 24 (e.g. a torsional spring, but not limited thereto). The base 12 has a pillar 26 extending along a Z-axis as shown in FIG. 2. The Z-axis, an X-axis and a Y-axis are perpendicular to each other. The resilient arm 16 is adjacent to the pillar 26. The cover 18 is disposed on the base 12. The sleeve 20 rotatably jackets the pillar 26 to be movable upward and downward between a high position and the low position along the Z-axis. The sleeve 20 has an outer annular surface 28. The outer annular surface 28 has a first convex portion 30, a first concave portion 32, a second convex portion 34, a second concave portion 36, and a protruding edge 38 located between the second convex portion 34 and the second concave portion 36. An upper end of the sleeve 20 passes through the cover 18 to be connected to the cap 14. The upward-force-applying member 22 abuts against the sleeve 20 and the base 12 respectively and could preferably be a spring (but not limited thereto) for providing an elastic force to drive the sleeve 20 to move away from the base 12. The flexible acoustic member 24 has a fixing rod 40 and a flexible rod 42. The fixing rod 40 is fixed to the base 12.

In this embodiment, as shown in FIG. 2, the button keyswitch 13 could further include a switch unit 43. The switch unit 43 includes the resilient arm 16 and a contact point 44. The resilient arm 16 and the contact point 44 are opposite to each other and extend toward the cap 14 respectively. The resilient arm 16 and the contact point 44 are electrically connected to a circuit board (not shown in the figures) of the keyswitch 10. To be more specific, when the sleeve 20 is located at the high position as shown in FIG. 3, the resilient arm 16 abuts against the first convex portion 30 at the first position $P_1$ (as shown in FIG. 4). Accordingly, the resilient arm 16 is biased outwardly by the first convex portion 30 for generating a first amount of deformation, so as to be separate from the contact point 44. Subsequently, when the sleeve 20 receives an external force via the cap 14 to move downward to the low position as shown in FIG. 7 through a position as shown in FIG. 6, the resilient arm 16 moves to a position corresponding to the first concave portion 32. During the aforesaid process, deformation of the resilient arm 16 is reduced to generate a second amount of deformation different from the first amount of deformation. In such a manner, the resilient arm 16 could abut against the contact point 44 for triggering the contact point 44, so as to generate a corresponding input signal to the circuit board of the keyswitch 10 for performing a corresponding input function.

On the other hand, when the external force is released, the upward-force-applying member 22 drives the sleeve 20 to move upward along the Z-axis relative to the pillar 26, so as to make the resilient arm 16 can move back to the first position $P_1$. As such, the purpose that the sleeve 20 can move back to its original position automatically can be achieved.

Via the aforesaid design, when the sleeve 20 rotates to make the resilient arm 16 abut against the first convex portion 30 at the first position $P_1$, the protruding edge 38 is misaligned with the flexible rod 42 (as shown in FIG. 4). Subsequently, when the sleeve 20 receives an external force to move downward along the Z-axis, the flexible rod 42 does not need to cross the protruding edge 38 and the resilient arm 16 moves from the first position $P_1$ to a position corresponding to the first concave portion 32 with downward movement of the sleeve 16. Accordingly, the keyswitch 10 can provide a non-clicky tactile feedback without a click sound when the user presses the cap 14.

Figure 8:
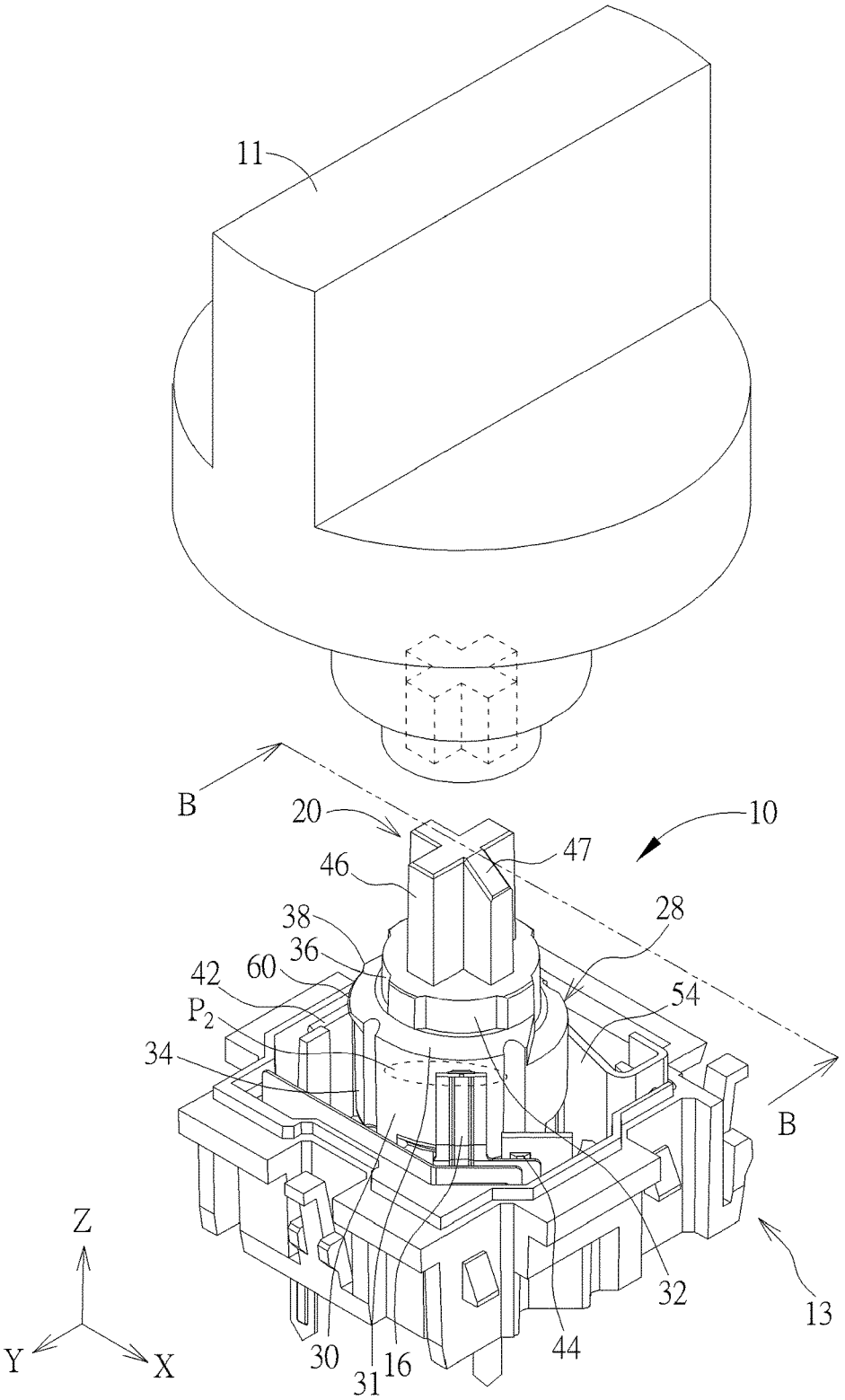
FIG. 8 is an exploded diagram of an adjusting tool and the keyswitch in FIG. 1 after the cap is detached.
Figure 9:
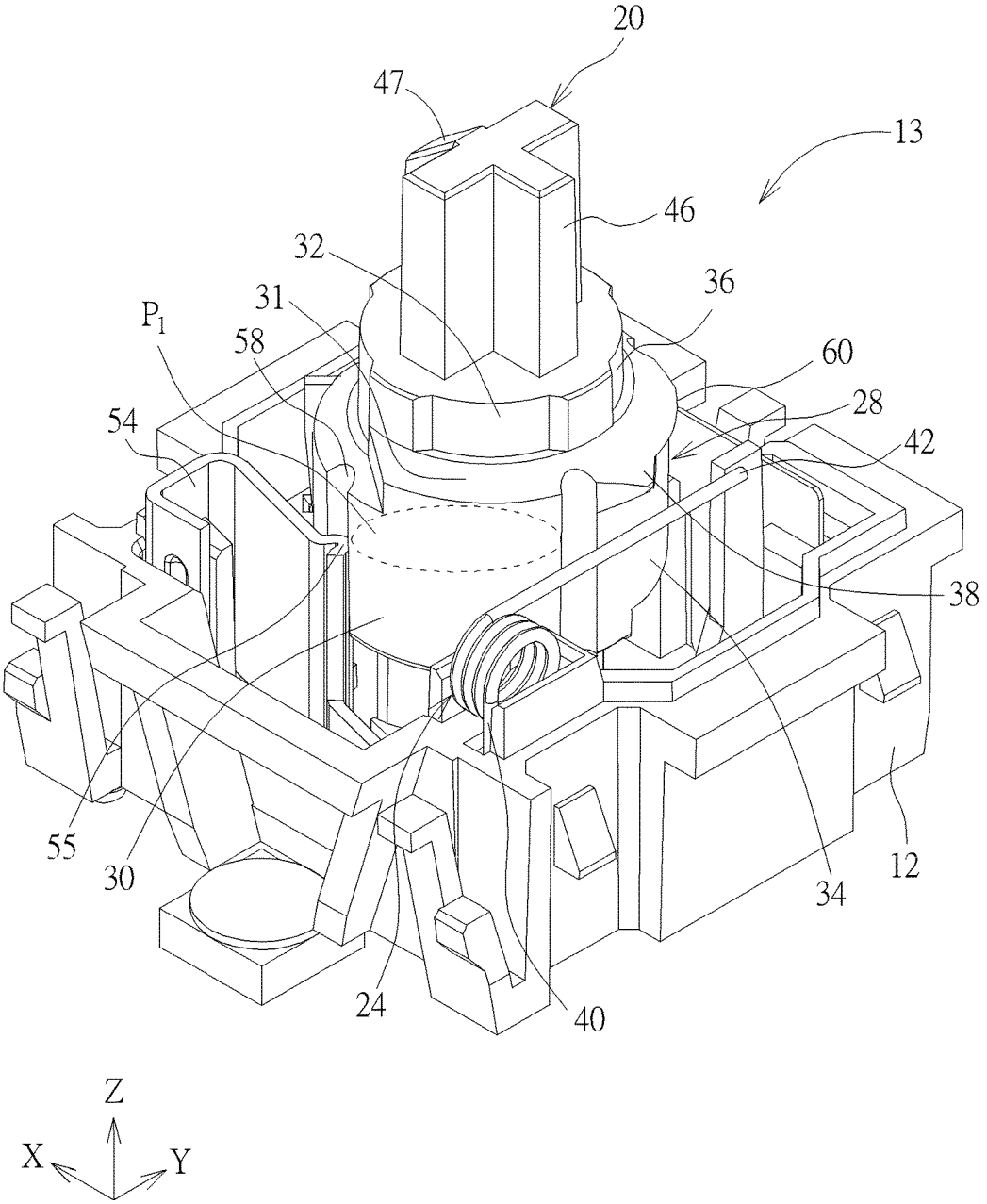
FIG. 9 is a diagram of the button switch in FIG. 8 from another viewing angle.
Figure 9A:
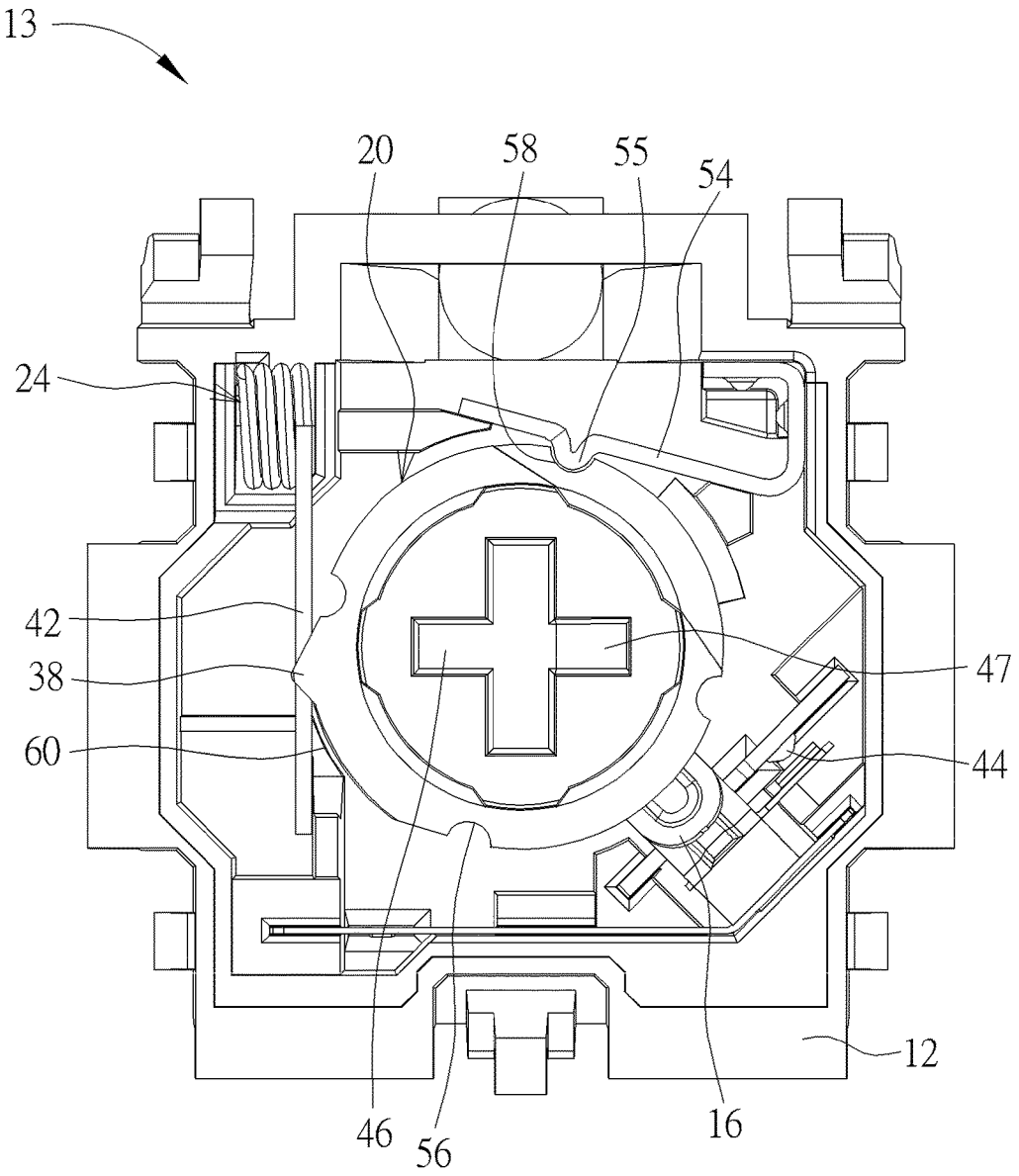
FIG. 9*a* is a top view of the button switch in FIG. 9.
Figure 10:
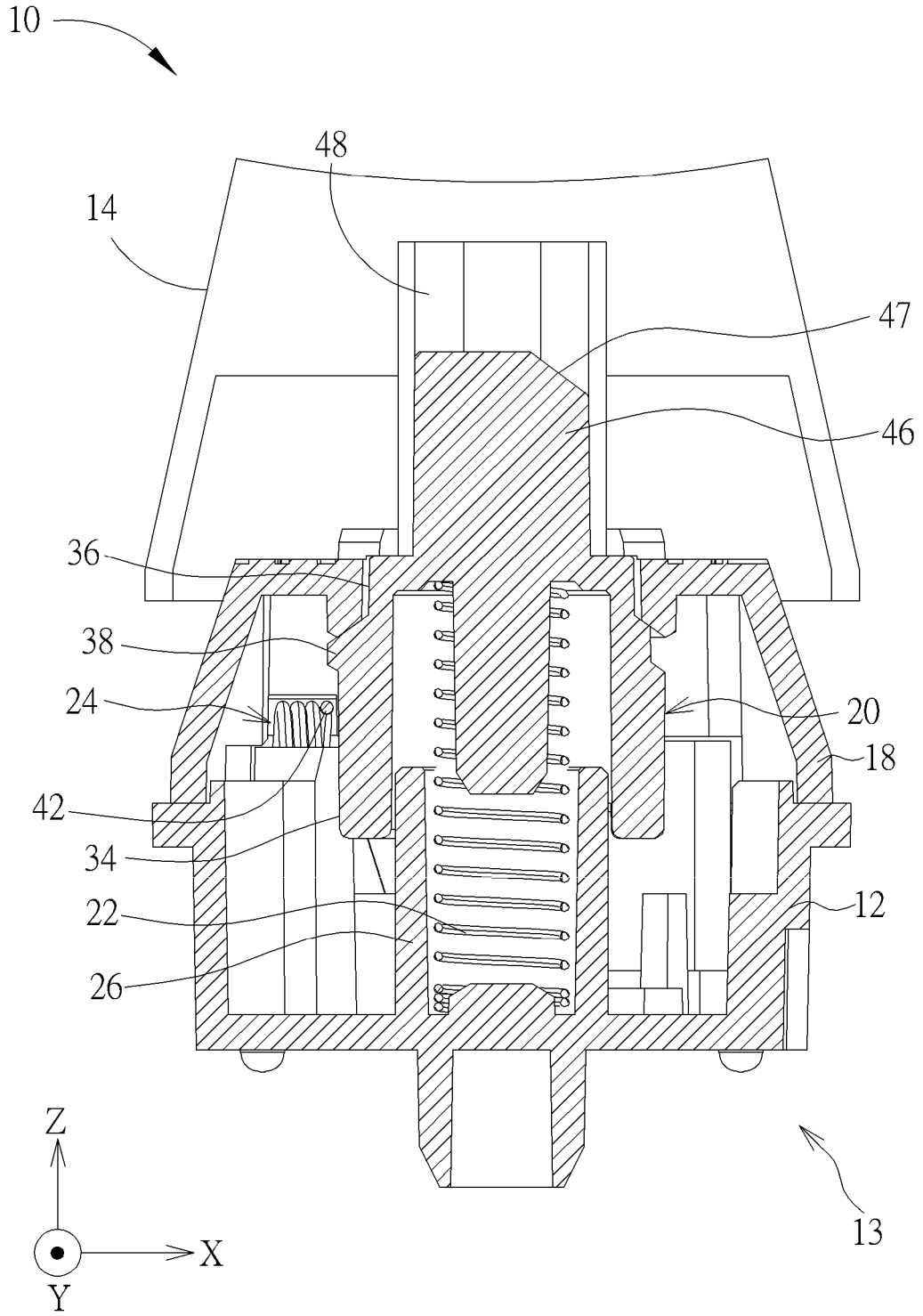
FIG. 10 is a cross-sectional diagram of the keyswitch in FIG. 8 along a cross-sectional line B-B.
Figure 11:
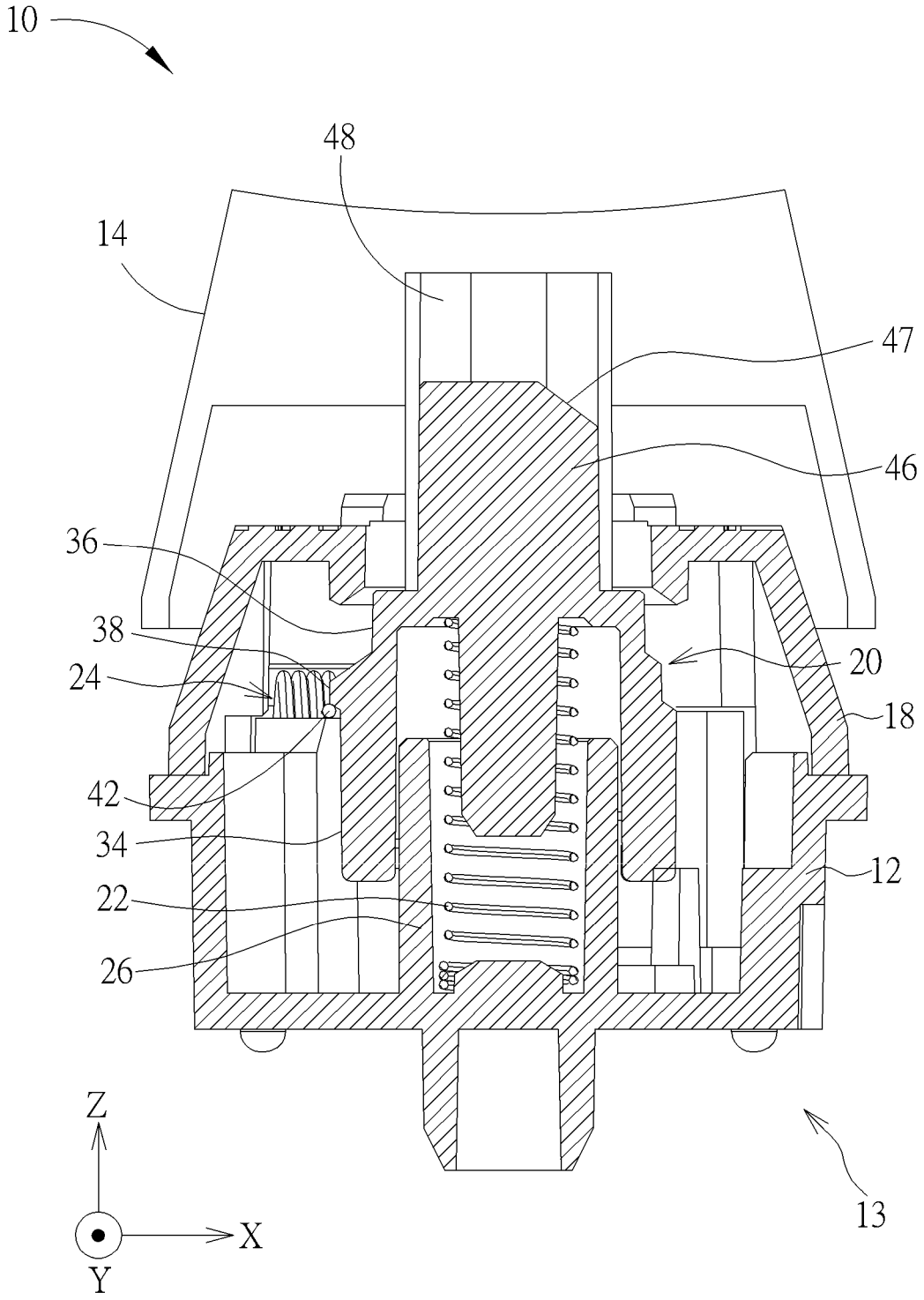
FIG. 11 is a cross-sectional diagram of a protruding edge in FIG. 10 pressing a flexible rod to deform downwardly with downward movement of the sleeve.
Figure 12:
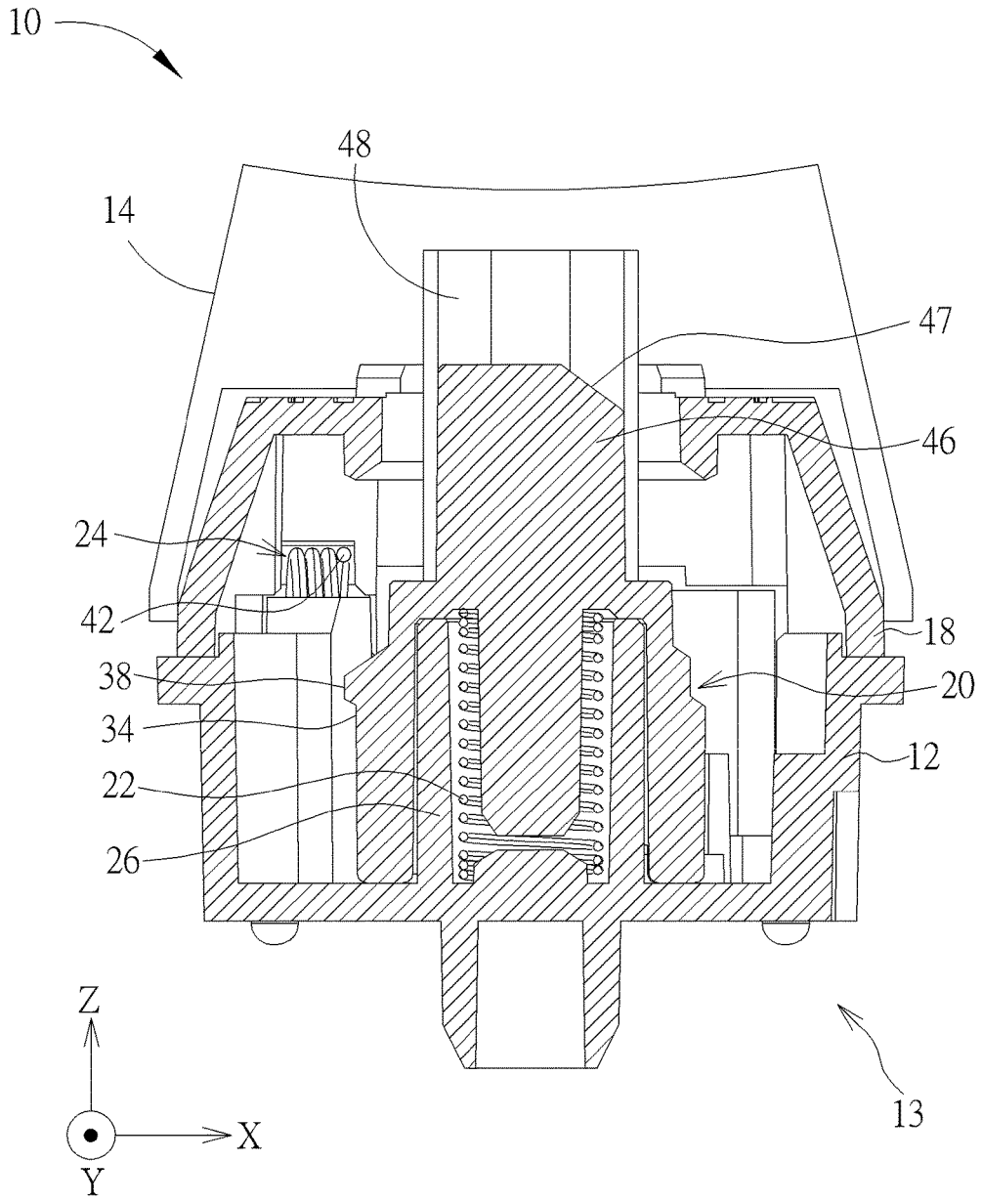
FIG. 12 is a cross-sectional diagram of the flexible rod in FIG. 11 crossing the protruding edge to be released.

More detailed description for the tactile feedback adjusting operation of the keyswitch 10 is provided as follows. Please refer to FIG. 2, FIG. 3, FIG. 4, FIG. 5, FIG. 7, FIG. 8, FIG. 9, FIG. 9*a*, FIG. 10, FIG. 11, and FIG. 12. FIG. 8 is an exploded diagram of an adjusting tool 11 and the keyswitch 10 in FIG. 1 after the cap 14 is detached. FIG. 9 is a diagram of the button switch 13 in FIG. 8 from another viewing angle. FIG. 9*a* is a top view of the button switch 13 in FIG. 9. FIG. 10 is a cross-sectional diagram of the keyswitch in FIG. 8 along a cross-sectional line B-B. FIG. 11 is a cross-sectional diagram of the protruding edge 38 in FIG. 10 pressing the flexible rod 42 to deform downwardly with downward movement of the sleeve 20. FIG. 12 is a cross-sectional diagram of the flexible rod 42 in FIG. 11 crossing the protruding edge 38 to be released. For clearly showing the internal structural design of the button switch 13, the cover 18 is omitted in FIG. 8.

When the user wants to switch the keyswitch 10 to provide a tactile feedback with a click sound, the user just needs to detach the cap 14 from the base 12, and then utilizes the adjusting tool 11 or a plier to rotate the sleeve 20 by 180° from the position as shown in FIG. 4 to a position as shown in FIG. 8 on the pillar 26 around the Z-axis (clockwise from a top view). Accordingly, the resilient arm 16 can abut against the first convex portion 30 at the second position $P_2$. During the aforesaid process, the sleeve 20 can rotate from a position where the protruding edge 38 is misaligned with the flexible rod 42 as shown in FIG. 4 to a position where the protruding edge 38 is located above the flexible rod 42 as shown in FIGS. 8-9.

In practical application, for improving the operational convenience of the keyswitch 10, as shown in FIG. 2 and FIG. 3, a protruding shaft 46 extends from the sleeve 20 toward the cap 14, and a concave slot 48 is formed on the cap 14 corresponding to the protruding shaft 46. The protruding shaft 46 is inserted into the concave slot 48 to make the cap 14 detachably connected to the sleeve 20. The protruding shaft 46 and the concave slot 48 could preferably be cross-shaped. A cross-shaped end of the protruding shaft 46 has a bevel edge 47. The cover 18 has a first mark 50 and a second mark 52. The bevel edge 47 is used for aligning with the first mark 50 to guide the sleeve 20 to rotate to a position where the resilient arm 16 abuts against the first convex portion 30 at the first position $P_1$ as shown in FIG. 4. The bevel edge 47 is further used for aligning with the second mark 52 to guide the sleeve 20 to rotate to a position where the resilient arm 16 abuts against the first convex portion 30 at the second position $P_2$ as shown in FIG. 8. As such, the aforesaid design can help the user rotate the sleeve 20 to a right position more precisely and quickly.

To be noted, as shown in FIG. 3, a structural height of the keyswitch 10 before being pressed can be determined by a connection height of the cap 14 and the sleeve 20. It means that the structural height of the keyswitch 10 can be adjusted to conform to a structural height of a conventional mechanical keyswitch after the protruding shaft 46 of the sleeve 20 is inserted into the concave slot 48 of the cap 14. Accordingly, the keyswitch 10 can be suitable for a conventional mechanical keyboard, so as to improve compatibility of the present invention.

During the aforesaid process of rotating the sleeve 20, for making the user surely aware of whether the sleeve 20 is rotated to a right position, as shown in FIG. 5, the button switch 13 could further include a resilient sheet 54. The resilient sheet 54 is fixed to the base 12, and the sleeve 20 has two positioning slots 56, 58 corresponding to the resilient sheet 54. A protruding structure 55 is formed on an end of the resilient sheet 54 corresponding to the two positioning slots 56, 58. Accordingly, when the protruding structure 55 is engaged with the positioning slot 56, the sleeve 20 is positioned to make the resilient arm 16 abut against the first convex portion 30 at the first position $P_1$. On the other hand, when the protruding structure 55 is engaged with the positioning slot 58, the sleeve 20 is positioned to make the resilient arm 16 abut against the first convex portion 30 at the second position $P_2$. The mark design and the positioning design mentioned above could be applied to the following operations for rotating the sleeve 20 to other positions, and the related description could be reasoned by analogy according to the aforesaid description and omitted herein.

After the aforesaid operations are completed and the cap 14 is assembled with the base 12 via the sleeve 20, the button switch 13 can provide a clicky tactile feedback with a click sound when the user presses the cap 14. To be more specific, as shown in FIG. 7, FIG. 8, FIG. 9, FIG. 9*a*, FIG. 10, FIG. 11, and FIG. 12, when the sleeve 20 rotates on the pillar 26 around the Z-axis to make the resilient arm 16 abut against the first convex portion 30 at the second position $P_2$ (as shown in FIG. 8), the protruding edge 38 is located above the flexible rod 42 (as shown in FIGS. 9 and 9*a*). Subsequently, the sleeve 20 receives the external force to move downward along the Z-axis. With downward movement of the sleeve 20, the flexible rod 42 needs to cross the protruding edge 38 and the resilient arm 16 moves from the second position $P_2$ to a position corresponding to the first concave portion 32.

When the cap 14 moves downward along the Z-axis and deformation of the flexible rod 42 caused by pressing of the protruding edge 38 is not enough to make the flexible rod 42 cross the protruding edge 38, the flexible rod 42 deforms downward cooperatively with the protruding edge 38 (as shown in FIG. 11). Subsequently, when deformation of the flexible rod 42 is enough to make the flexible rod 42 cross the protruding edge 38, the deformed flexible rod 42 is no longer pressed by the protruding edge 38. At this time, the flexible rod 42 is released to move upward to a position as shown in FIG. 12 and then collides with the cover 18 for making a click sound. In such a manner, the button switch 13 can provide a clicky tactile feedback when the protruding point 38 presses the flexible rod 42 to deform and then the flexible rod 42 is released, and the button switch 13 can further provide a tactile feedback with a click sound when the flexible rod 42 collides with the cover 18. Finally, when the sleeve 20 is pressed to the low position as shown in FIG. 7, the resilient arm 16 moves to a position corresponding to the second concave portion 58. During the aforesaid process, deformation of the resilient arm 16 is reduced to make the resilient arm 16 trigger the contact point 44, so as to generate a corresponding input signal to the circuit board of the keyswitch 10 for performing a corresponding input function.

Figure 13:
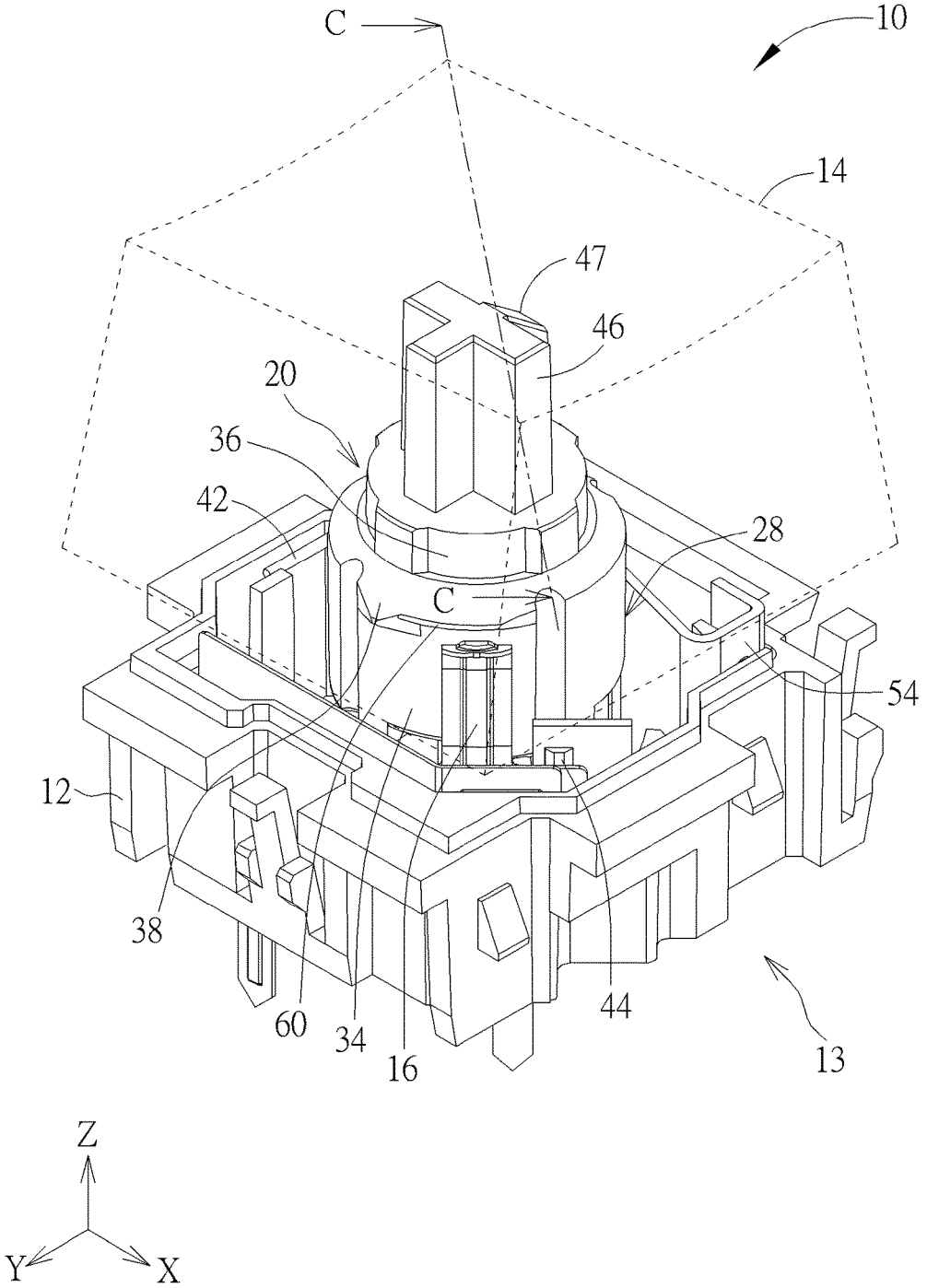
FIG. 13 is a diagram of the keyswitch in FIG. 8 when the sleeve rotates 90° to make a resilient arm abut against a second convex portion.
Figure 14:
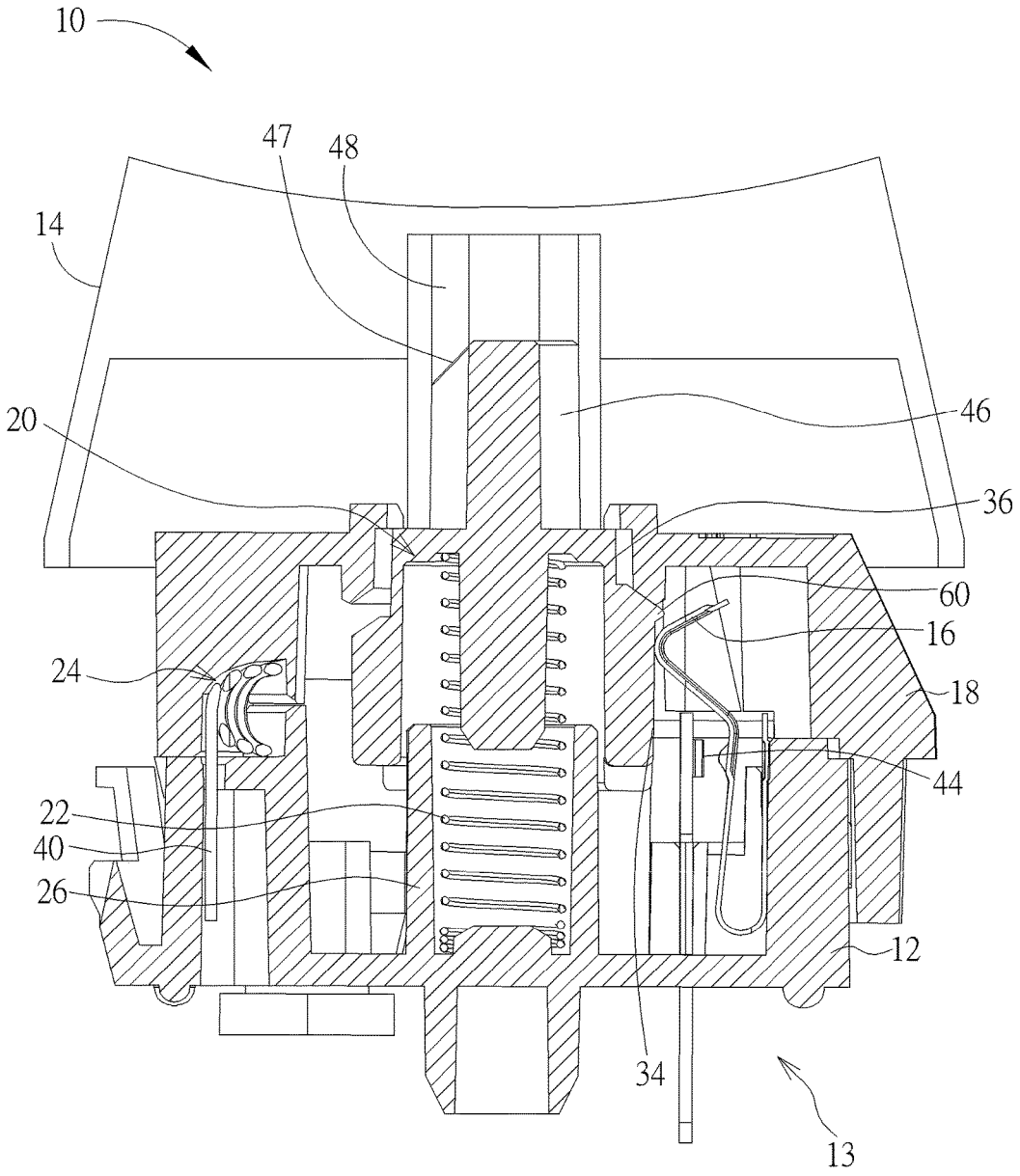
FIG. 14 is a cross-sectional diagram of the keyswitch in FIG. 13 along a cross-sectional line C-C.
Figure 15:
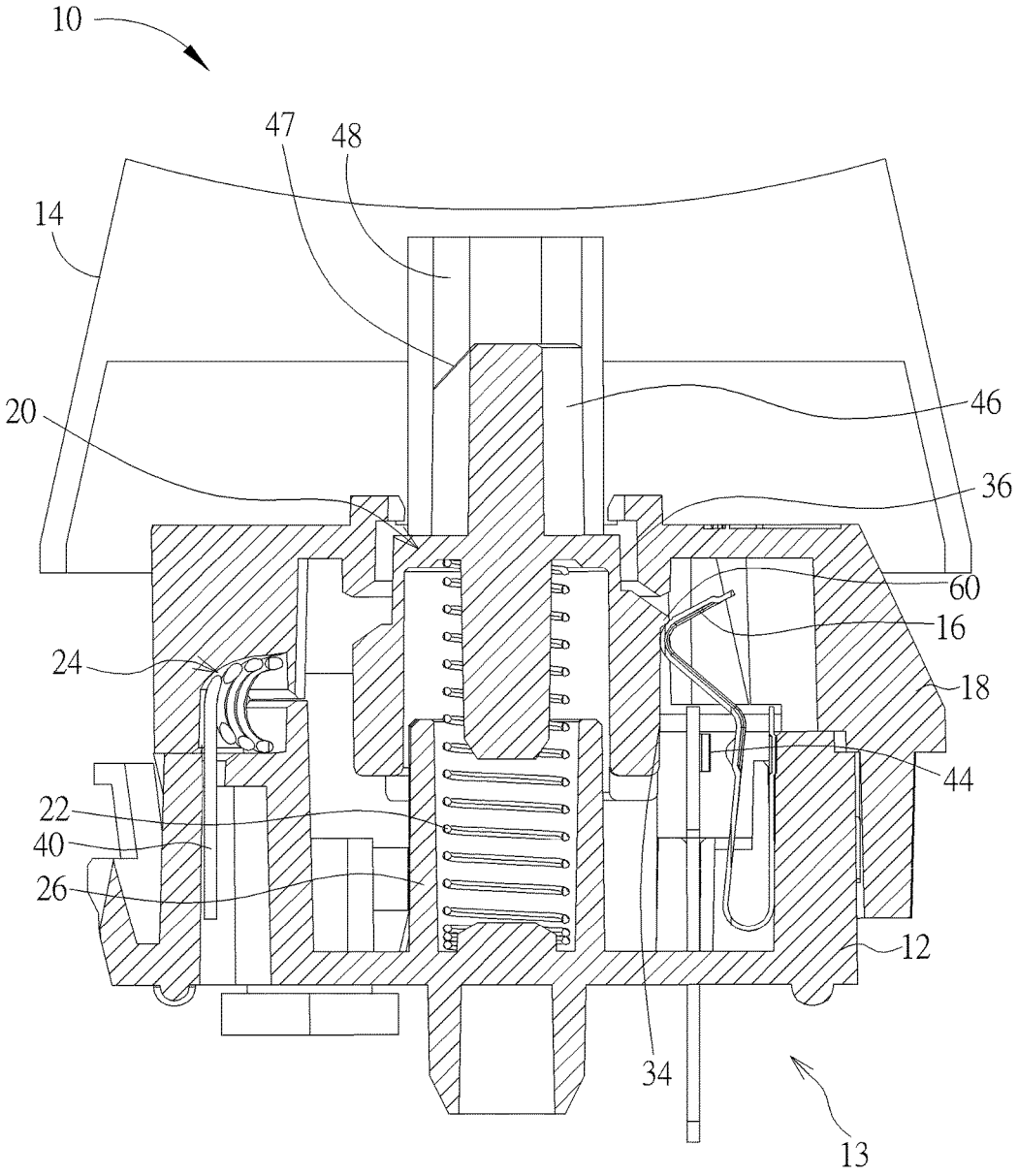
FIG. 15 is a cross-sectional diagram of the sleeve in FIG. 14 being pressed via the cap to a position where the resilient arm abuts against the second convex portion and is located under an arc-shaped bar.
Figure 15A:
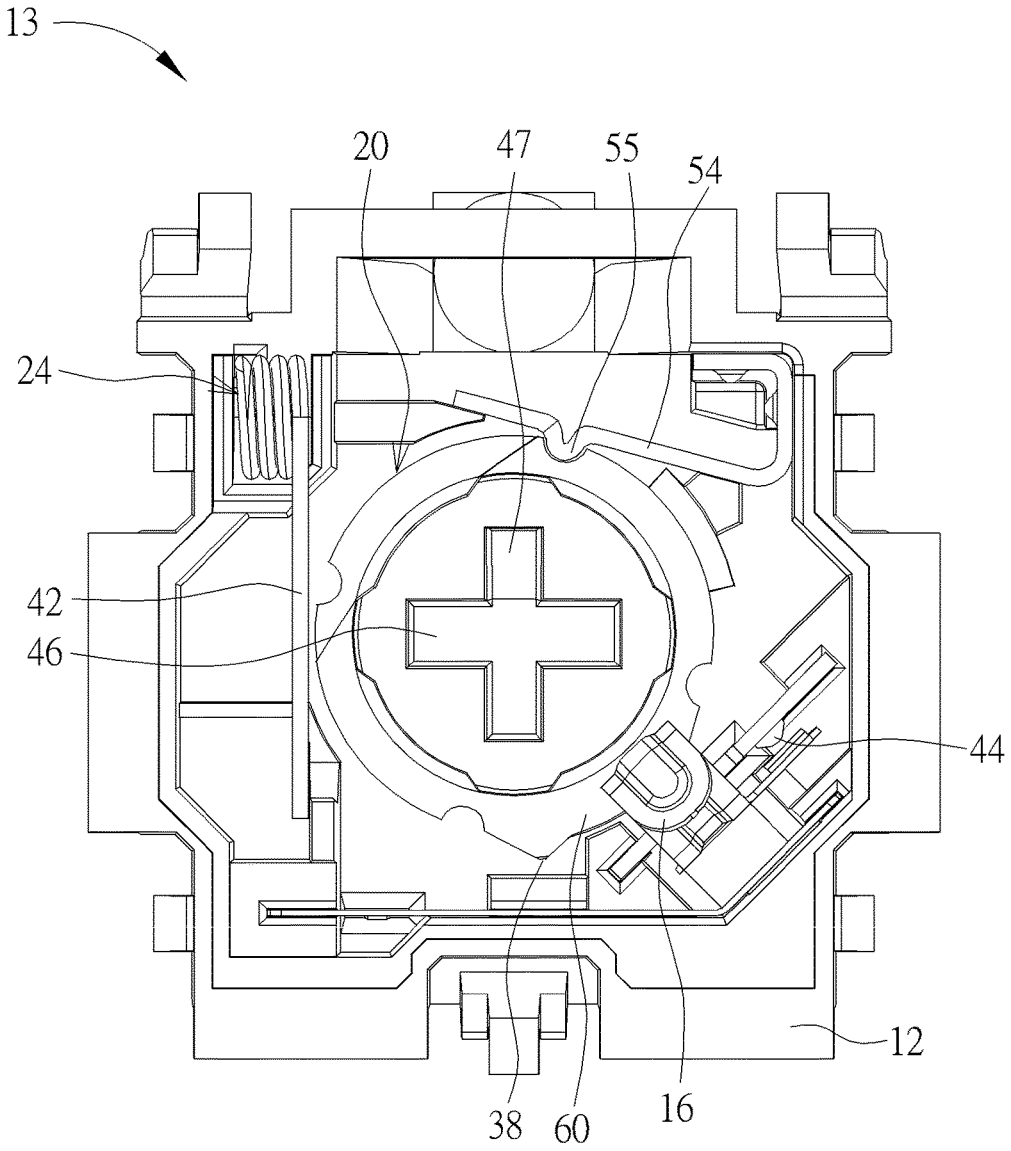
FIG. 15*a* is a top view of the resilient arm in FIG. 15 crossing the arc-shaped bar.
Figure 16:
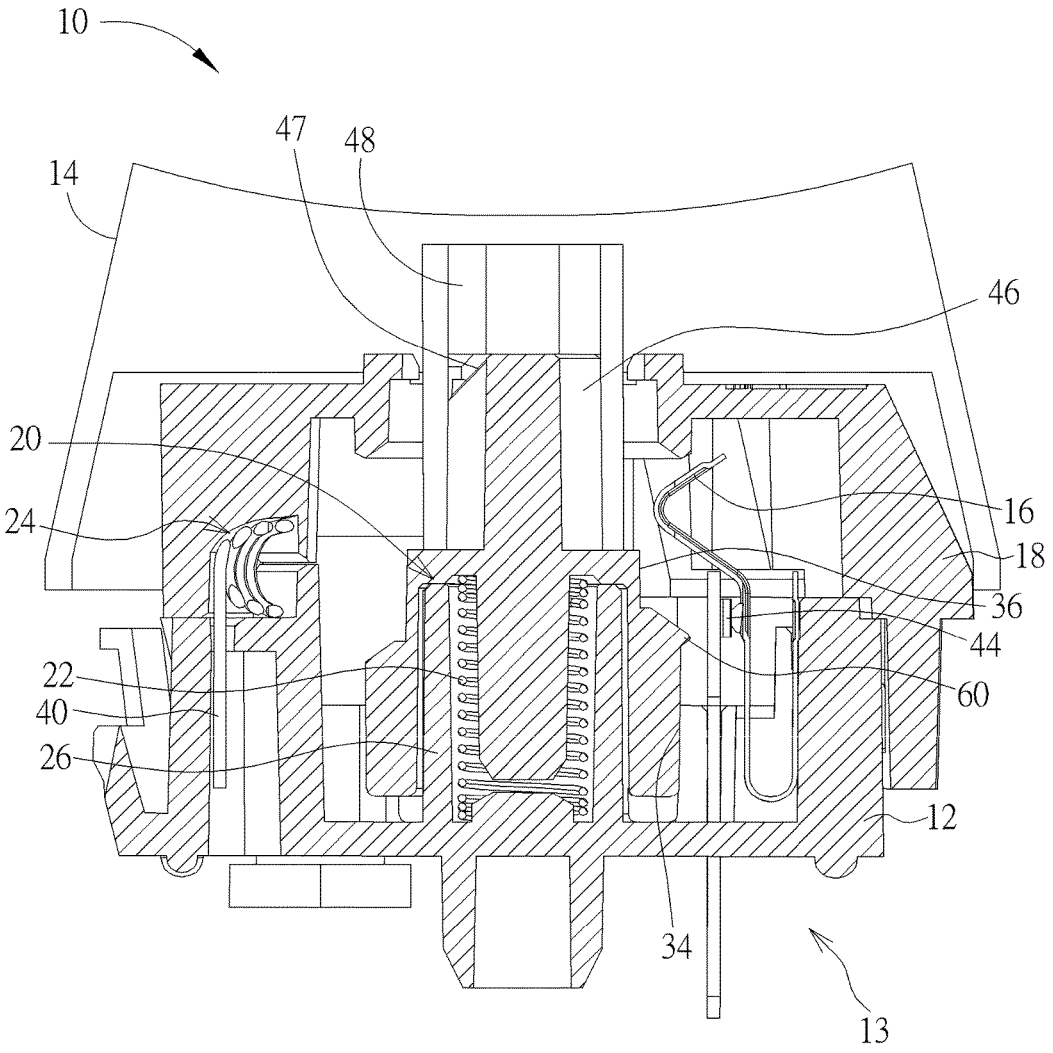
FIG. 16 is a cross-sectional diagram of the sleeve in FIG. 15 being pressed to the low position.

Please refer to FIG. 8, FIG. 13, FIG. 14, and FIG. 15, FIG. 15*a*, and FIG. 16. FIG. 13 is a diagram of the keyswitch 10 in FIG. 8 when the sleeve 20 rotates 90° (counterclockwise from a top view) to make the resilient arm 16 abut against a second convex portion 34. FIG. 14 is a cross-sectional diagram of the keyswitch 10 in FIG. 13 along a cross-sectional line C-C. FIG. 15 is a cross-sectional diagram of the sleeve 20 in FIG. 14 being pressed via the cap 14 to a position where the resilient arm 16 abuts against the second convex portion 34 and is located under an arc-shaped bar 60. FIG. 15*a* is a top view of the resilient arm 16 in FIG. 15 crossing the arc-shaped bar 60. FIG. 16 is a cross-sectional diagram of the sleeve 20 in FIG. 15 being pressed to the low position. For clearly showing the internal structural design of the button switch 13, the cover 18 is omitted in FIG. 13. As shown in FIG. 8, FIG. 13, FIG. 14, FIG. 15, FIG. 15*a*, and FIG. 16, the outer annular surface 28 could further have the arc-shaped bar 60. The arc-shaped bar 60 extends above the second convex portion 34, but does not extend above the first convex portion 30 (as shown in FIG. 8).

Via the aforesaid design, when the user wants to switch the button switch 13 to only provide a clicky tactile feedback, the user just needs to detach the cap 14 from the sleeve 20 and then rotate the sleeve 20 on the pillar 26 around the Z-axis by 90° (e.g. rotating the sleeve 20 by utilizing the adjusting tool 11 to rotate the sleeve 20) from the position where the resilient arm 16 abuts against the first convex portion 30 as shown in FIG. 8 counterclockwise to a position where the resilient arm 16 abuts against the second convex portion 34 as shown in FIG. 13.

After the aforesaid operations are completed and the cap 14 is assembled with the base 12 via the sleeve 20, the button switch 13 can provide a clicky tactile feedback when the user presses the cap 14. To be more specific, as shown in FIG. 14, when the sleeve 20 is located at the high position and the resilient arm 16 abuts against the second convex portion 34, the resilient arm 16 is biased outwardly to be separate from the contact point 44. Subsequently, when the sleeve 20 receives an external force via the cap 14 to move downward, as shown in FIG. 15 and FIG. 15*a*, the resilient arm 16 abuts against the bottom of the arc-shaped bar 60 first and then crosses the arc-shaped bar 60, so as to provide a clicky tactile feedback when the user presses the cap 14.

Finally, the resilient arm 20 moves from the second convex portion 34 to a position corresponding to the second concave portion 36 when the sleeve 20 is pressed to the low position as shown in FIG. 16. During the aforesaid process, deformation of the resilient arm 16 is reduced to make the resilient arm 16 trigger the contact point 44, so as to generate a corresponding input signal to the circuit board of the keyswitch 10 for performing a corresponding input function.

Figure 17:
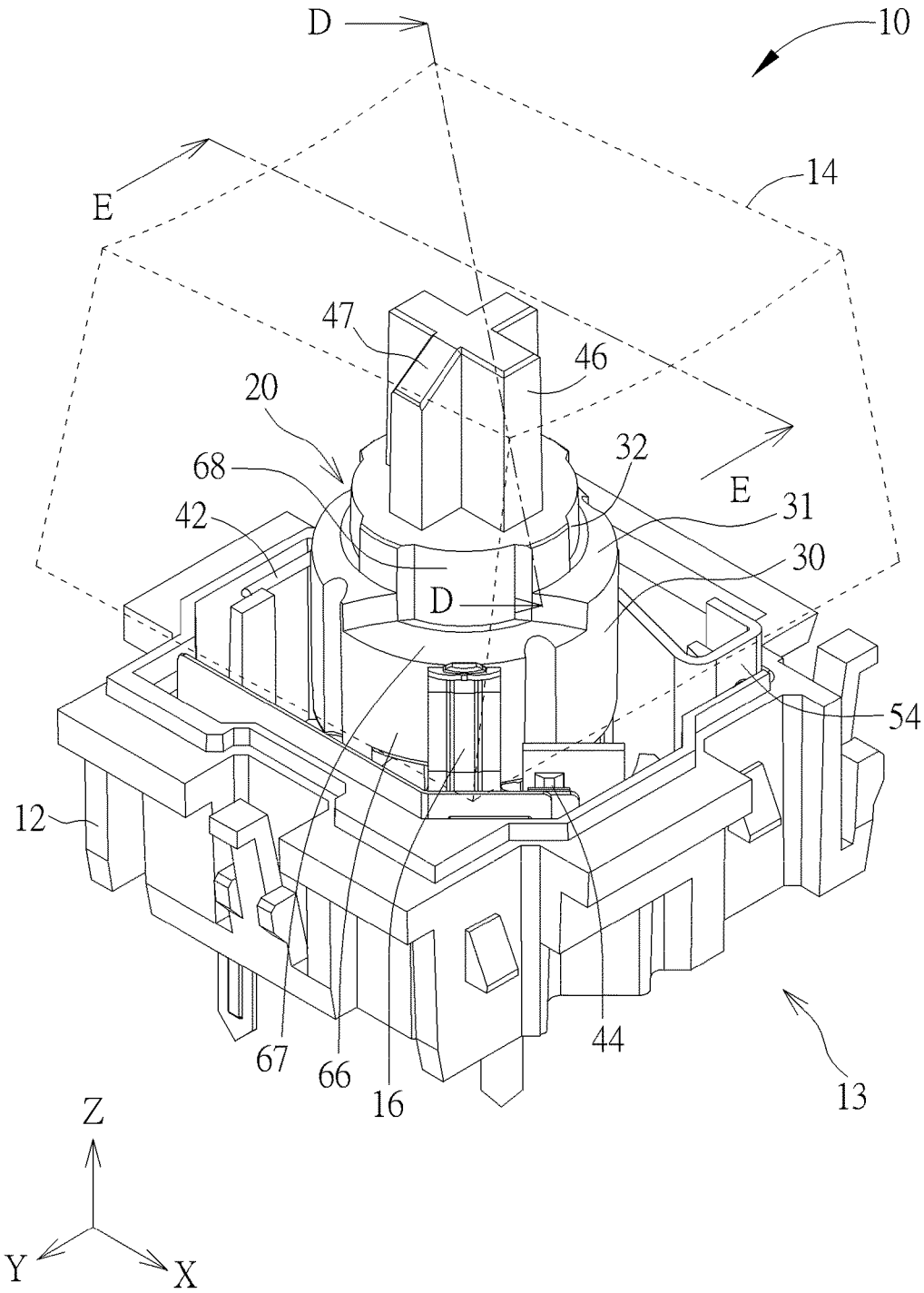
FIG. 17 is a diagram of the keyswitch in FIG. 4 when the sleeve rotates 90° to make the resilient arm abut against a second convex portion.
Figure 18:
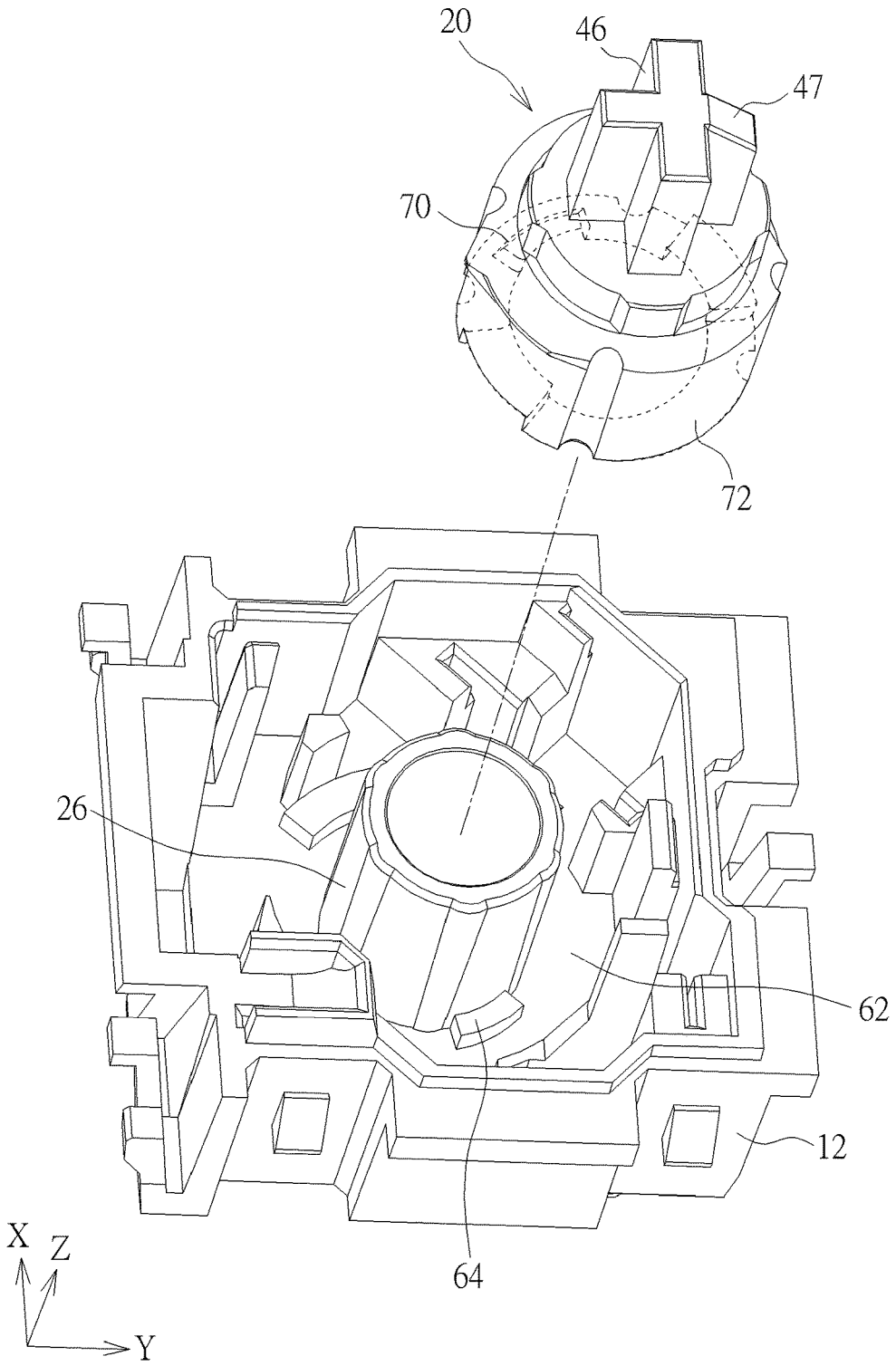
FIG. 18 is an exploded diagram of the sleeve and the base in FIG. 17 from another viewing angle.
Figure 19:
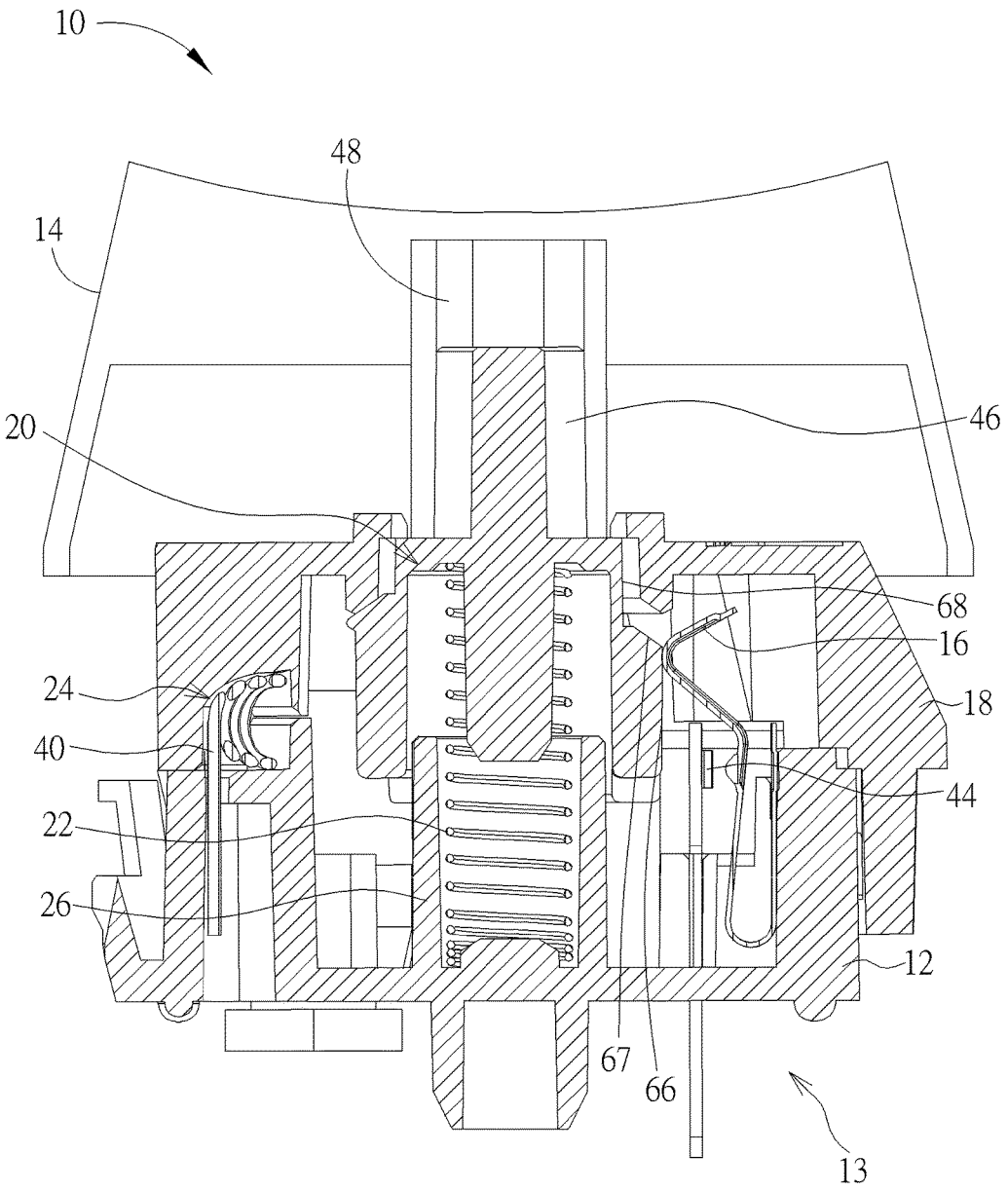
FIG. 19 is a cross-sectional diagram of the keyswitch in FIG. 17 along a cross-sectional line D-D.
Figure 20:
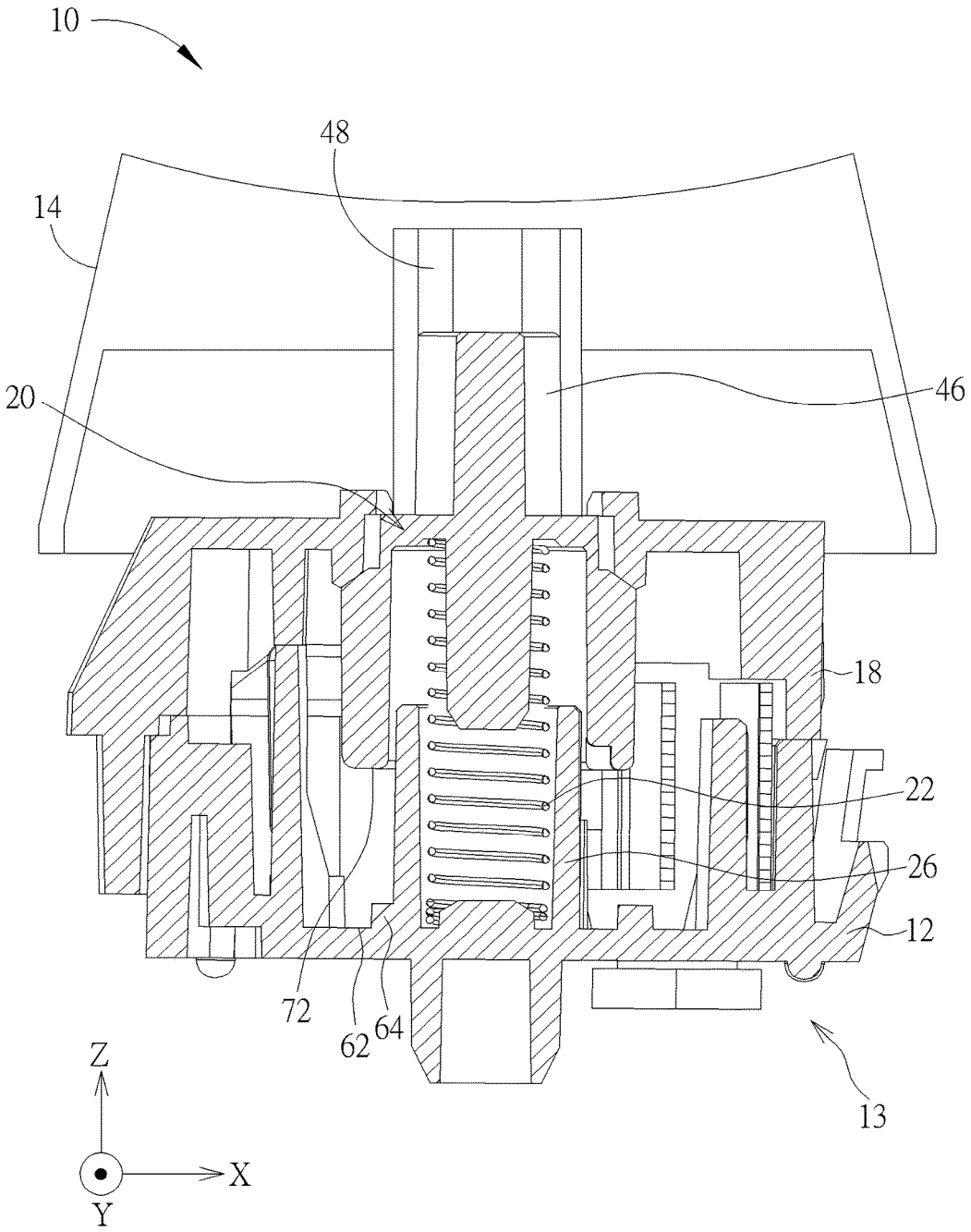
FIG. 20 is a cross-sectional diagram of the keyswitch in FIG. 17 along a cross-sectional line E-E.
Figure 21:
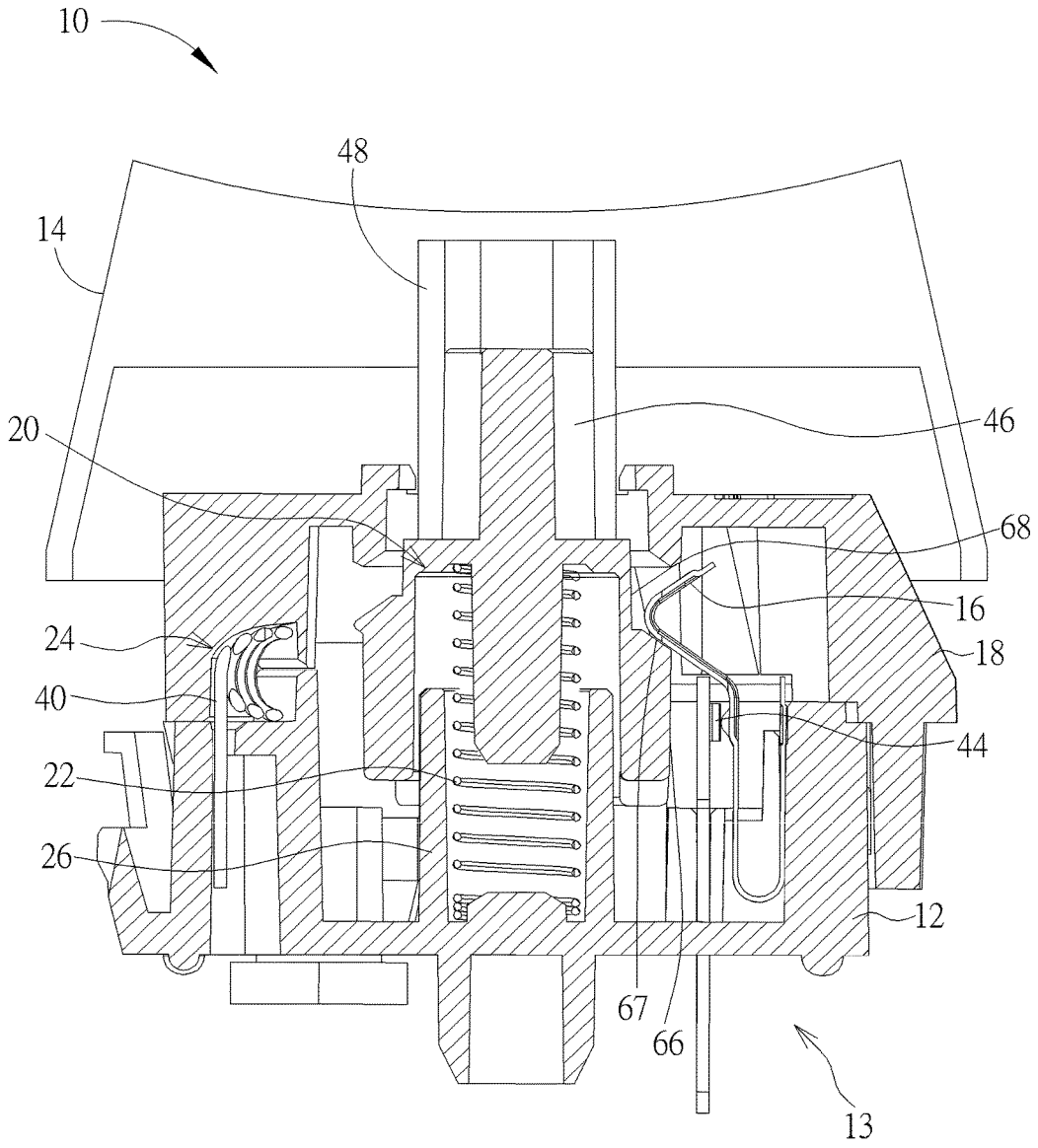
FIG. 21 is a cross-sectional diagram of the sleeve in FIG. 19 being pressed via the cap.
Figure 22:
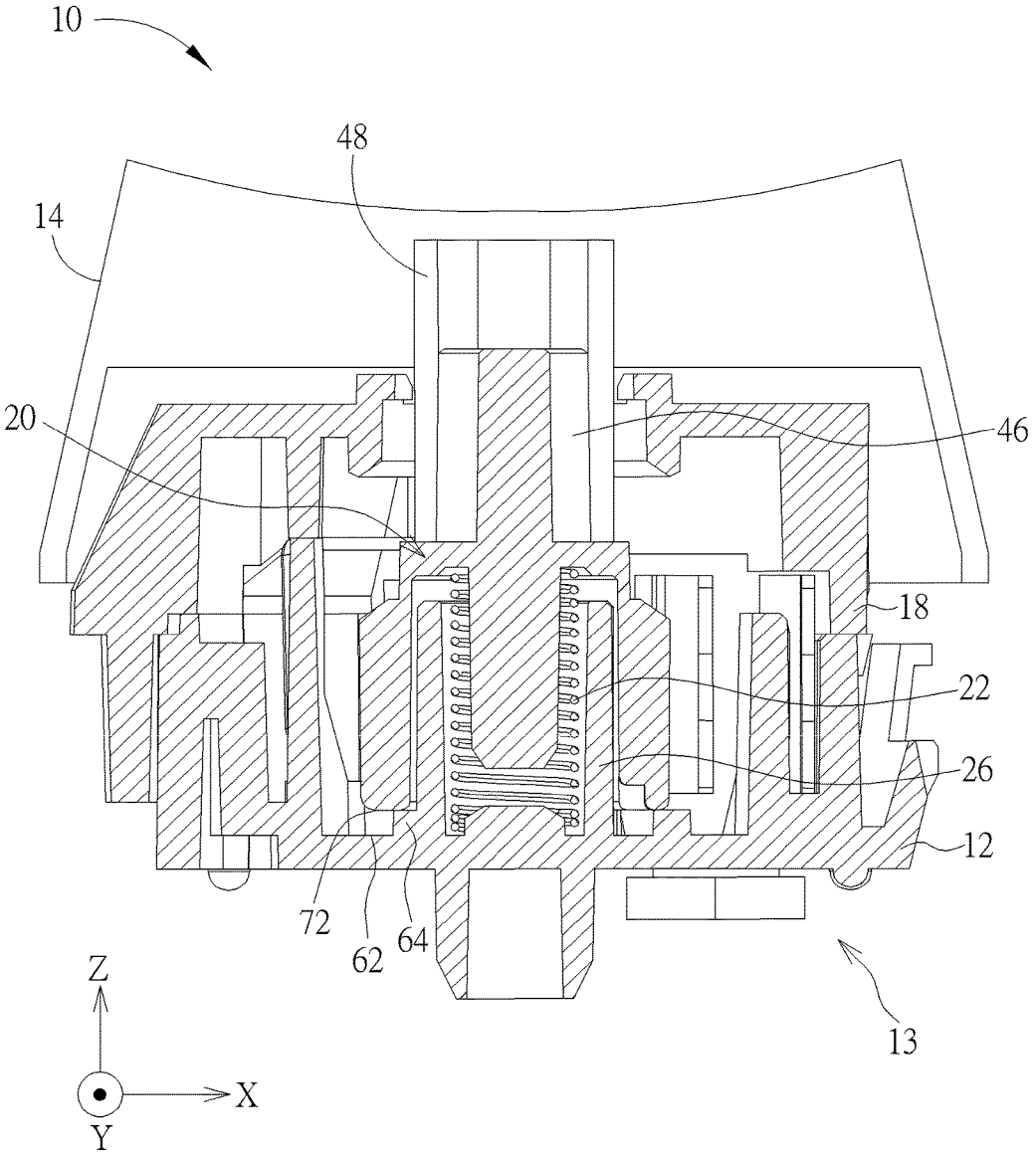
FIG. 22 is a cross-sectional diagram of the sleeve in FIG. 20 being pressed to the low position.
Figure 23:
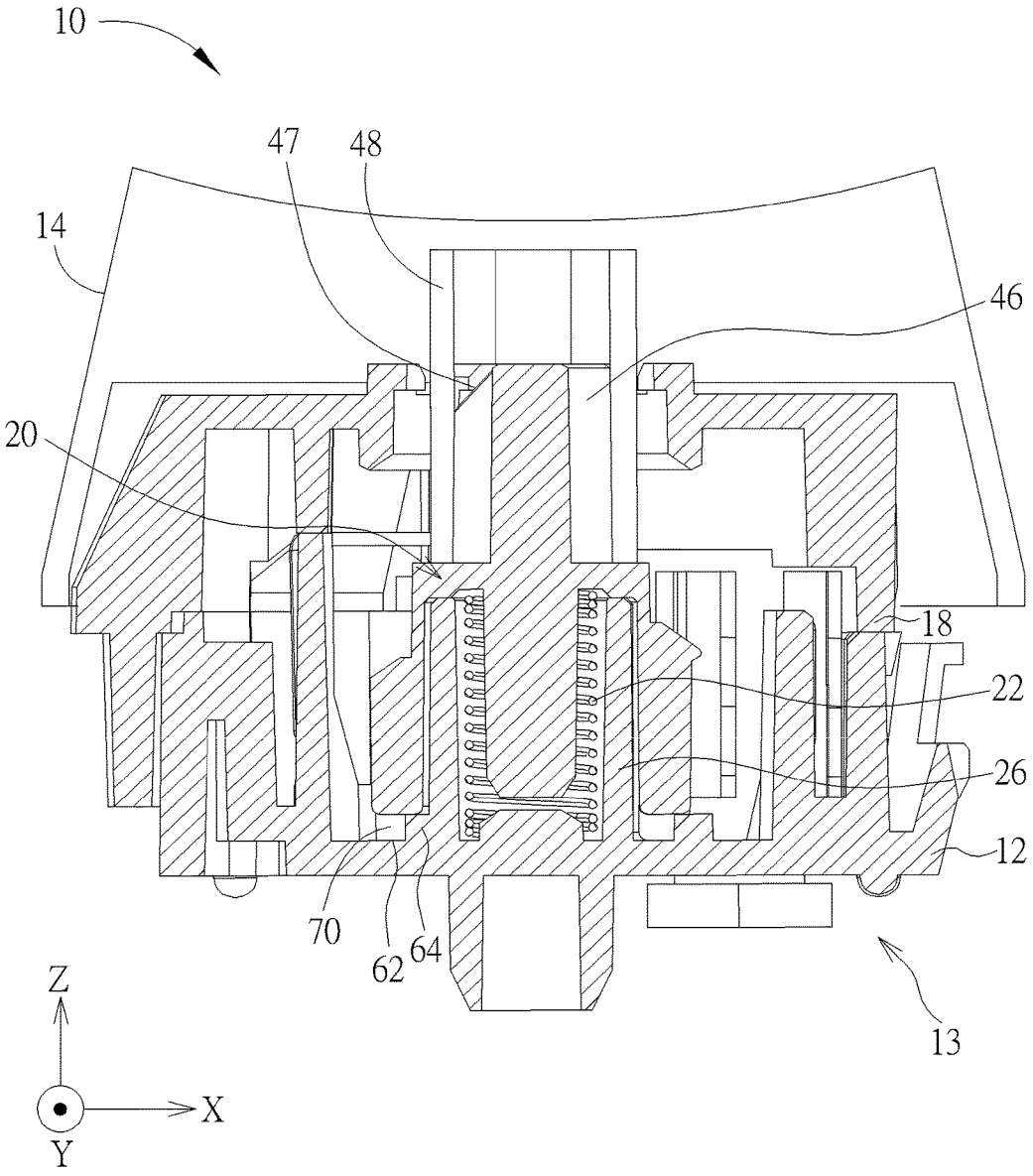
FIG. 23 is a cross-sectional diagram of the keyswitch in FIG. 1 along a cross-sectional line F-F when the sleeve is pressed to the low position.

Please refer to FIG. 3, FIG. 4, FIG. 6, FIG. 17, FIG. 18, FIG. 19, FIG. 20, FIG. 21, FIG. 22, and FIG. 23. FIG. 17 is a diagram of the keyswitch 10 in FIG. 4 when the sleeve 20 rotates 90° (counterclockwise from a top view) to make the resilient arm 16 abut against a second convex portion 66. FIG. 18 is an exploded diagram of the sleeve 20 and the base 12 in FIG. 17 from another viewing angle. FIG. 19 is a cross-sectional diagram of the keyswitch 10 in FIG. 17 along a cross-sectional line D-D. FIG. 20 is a cross-sectional diagram of the keyswitch 10 in FIG. 17 along a cross-sectional line E-E. FIG. 21 is a cross-sectional diagram of the sleeve 20 in FIG. 19 being pressed via the cap 14. FIG. 22 is a cross-sectional diagram of the sleeve 20 in FIG. 20 being pressed to the low position. FIG. 23 is a cross-sectional diagram of the keyswitch 10 in FIG. 1 along a cross-sectional line F-F when the sleeve 20 is pressed to the low position. For clearly showing the internal structural design of the button switch 13, the cover 18 is omitted in FIG. 17.

As shown in FIG. 4, FIG. 17 and FIG. 18, the base 12 could further have a top surface 62 and a protruding block 64. The protruding block 64 is adjacent to the pillar 26 and is higher than the top surface 62 along the Z-axis. The outer annular surface 28 could further have a first transition portion 31, a second convex portion 66, a second transition portion 67 and a second concave portion 68. A groove 70 and a bottom surface 72 are formed on a bottom end of the sleeve 20. The sleeve 20 is rotatable on the pillar 26 around the Z-axis to make the protruding block 64 selectively located under the groove 70 or the bottom surface 72. The first convex portion 30, the first transition portion 31, and the first concave portion 32 are arranged from down to up along the Z-axis, and the second convex portion 66, the second transition portion 67, and the second concave portion 68 are arranged from down to up along the Z-axis. The first transition portion 31 is higher than the second transition portion 67 along the Z-axis. A first triggering position is defined by where the first transition portion 31 and the first concave portion 32 meet, and a second triggering position is defined by where the second transition portion 67 and the second concave portion 68 meet (but not limited thereto). That is to say, the first triggering position is higher than the second triggering position.

Via the aforesaid design, when the sleeve 20 is located at the high position as shown in FIG. 4, the resilient arm 16 abuts against the first convex portion 30 to be separate from the contact point 44. Subsequently, when the sleeve 20 receives the external force to move downward to the low position as shown in FIG. 23, the resilient arm 16 moves to a position corresponding to the first concave portion 32 instead. During this process, deformation of the resilient arm 16 is reduced to make the resilient arm 16 contact the contact point 44 for generating a corresponding input signal to the circuit board of the keyswitch 10, so that the keyswitch 10 could perform a corresponding input function. Furthermore, as shown in FIG. 23, when the protruding block 64 is located under the groove 70 and the sleeve 20 receives the external force, the sleeve 20 moves downward along the Z-axis until the protruding block 64 is contained in the groove 70. In such a manner, a maximum movable distance of the sleeve 20 along the Z-axis is set as a first travel distance, so as to provide a tactile feedback with a relatively long travel distance of the sleeve 20 when the user presses the keyswitch 10.

On the other hand, when the user wants to perform the travel distance adjusting operation of the button switch 13, the user just needs to rotate the sleeve 20 around the Z-axis by 90° from a position where the resilient arm 16 abuts against the first convex portion 30 as shown in FIG. 4 (at this time, as shown in FIG. 23, the protruding block 64 is located under the groove 70) counterclockwise to a position where the resilient arm 16 abuts against the second convex portion 66 as shown in FIG. 17 (at this time, as shown in FIG. 20, the protruding block 64 is located under the bottom surface 72).

In such a manner, when the protruding block 64 is located under the bottom surface 72 and the sleeve 20 receives the external force to move downward, the sleeve 20 moves downward along the Z-axis until the protruding block 64 abuts against the bottom surface 72 (as shown in FIG. 22). Accordingly, the maximum movable distance of the sleeve 20 along the Z-axis is set as a second travel distance. As shown in FIG. 22 and FIG. 23, the second travel distance is smaller than the first travel distance, so as to provide a tactile feedback with a relatively short travel distance of the sleeve 20 when the user presses the keyswitch 10.

During the aforesaid process, as shown in FIG. 6, the resilient arm 16 move upward from the first convex portion 30 to the position corresponding to the first concave portion 32 via the first transition portion 31. Accordingly, deformation of the resilient arm 16 is reduced to make the resilient arm 16 located at the first triggering position as shown in FIG. 6 to trigger the contact point 44. As such, since the resilient arm 16 triggers the contact point 44 at the first triggering position as shown in FIG. 6, the button switch 13 could provide a tactile feedback that the button switch 13 is triggered at a relatively low triggering position when the user presses the cap 14.

On the other hand, when the user wants to adjust the triggering position of the button switch 13, the user just needs to rotate the sleeve 20 around the Z-axis by 90° from the position where the resilient arm 16 abuts against the first convex portion 30 as shown in FIG. 4 counterclockwise to a position where the resilient arm 16 abuts against the second convex portion 66 as shown in FIG. 17. In such a manner, when the sleeve 20 is located at the high position as shown in FIG. 19, the resilient arm 16 abuts against the second convex portion 66 to be separate from the contact point 44. When the sleeve 20 receives the external force to move downward along the Z-axis, the resilient arm 16 moves upward from the second convex portion 66 to a position corresponding to the second concave portion 68 via the second transition portion 67. Accordingly, deformation of the resilient arm 16 is reduced to make the resilient arm 16 located at the second triggering position as shown in FIG. 21 to trigger the contact point 44.

As shown in FIG. 6 and FIG. 21, since the second transition portion 67 is lower than the first transition portion 31, the sleeve 20 just needs to move a shorter distance downward (as shown in FIG. 19 and FIG. 21) to make the resilient arm 16 abut against the contact point 44 at the second triggering position (at this time, the cap 14 is located at a relatively high triggering position). On the contrary, as shown in FIG. 3 and FIG. 6, the sleeve 20 needs to move a longer distance downward to make the resilient arm 16 abut against the contact point 44 at the first triggering position (at this time, the cap 14 is located at a relatively low triggering position). Accordingly, the button switch 13 allows that the user could switch the keyswitch 10 to provide a tactile feedback that the cap 14 is triggered at the relatively high triggering position or the relatively low triggering position during the user presses the cap 14.

It should be mentioned that the switching design of the button switch provided by the present invention is not limited to the aforesaid embodiments (i.e. switching the button switch 13 from a non-clicky tactile feedback with no click sound to a tactile feedback with a click sound, a clicky tactile feedback or a tactile feedback that the button switch 13 is triggered at a relatively low triggering position with a relatively short travel distance of the sleeve 20). For example, in another embodiment, the present invention could only adopt the design that the resilient arm abuts against the first convex portion or the second convex portion under the arc-shaped bar with rotation of the sleeve, so as to switch the button switch to provide a clicky or non-clicky tactile feedback for simplifying the structural design of the button switch.

Further, in another embodiment, the present invention could only adopt the design that the protruding edge of the sleeve is misaligned with or located above the flexible rod of the flexible acoustic member with rotation of the sleeve, so as to switch the button switch to provide a tactile feedback with or without a click sound.

Further, in another embodiment, the present invention could only adopt the design that the protruding block of the base is located under the groove or the bottom surface of the sleeve, so as to switch the button switch to provide a tactile feedback with a long or short travel distance of the sleeve 20.

Further, in another embodiment, the present invention could only adopt the design that the resilient arm triggers the contact point at the different triggering positions with rotation of the sleeve, so as to switch the button switch to provide a tactile feedback that the button switch is triggered at a low or high triggering position. As for other derived embodiments (e.g. a three-stage switching embodiment that selectively switches the button switch from a non-clicky tactile feedback with no click sound to a tactile feedback with a click sound or a tactile feedback with a different travel distance of the sleeve), the related description could be reasoned by analogy according to the aforesaid embodiments and omitted herein.

Figure 24:
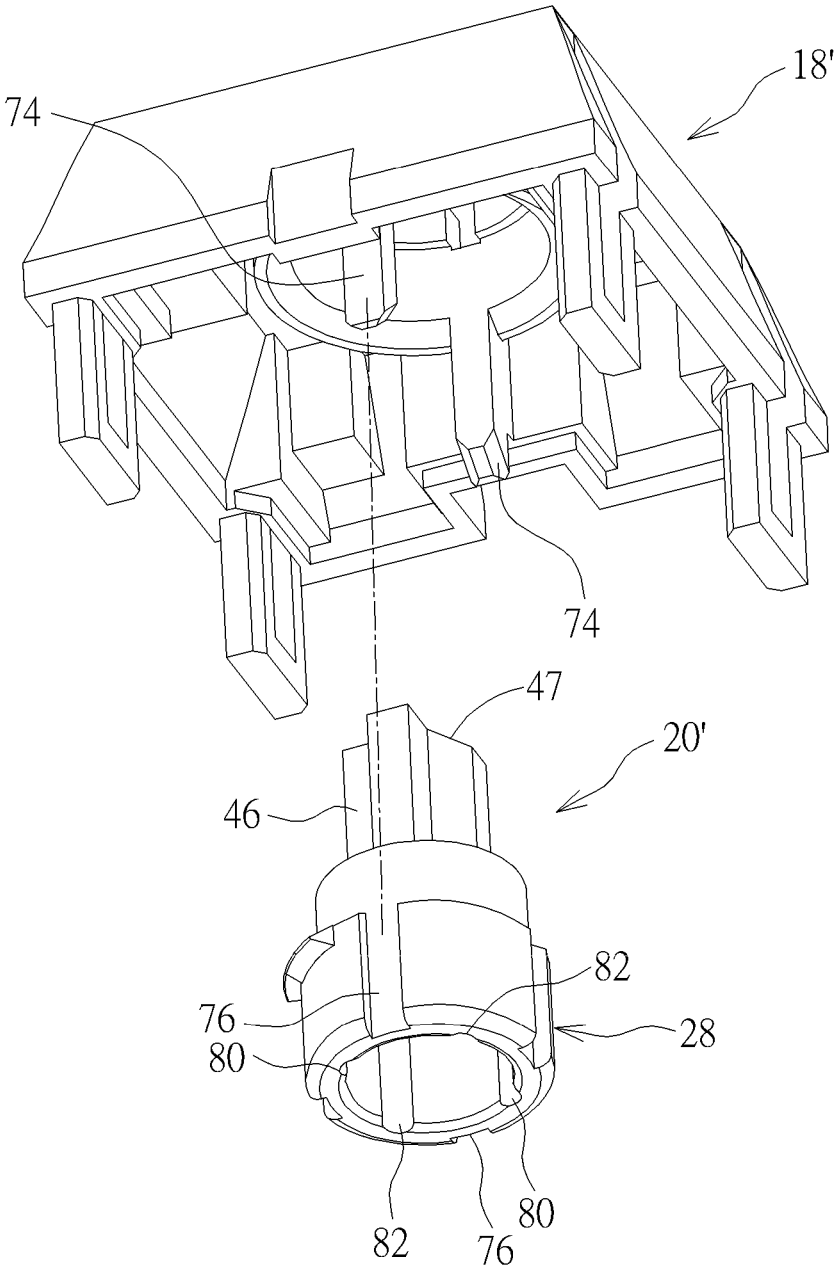
FIG. 24 is an exploded diagram of a cover and a sleeve according to another embodiment of the present invention.
Figure 25:
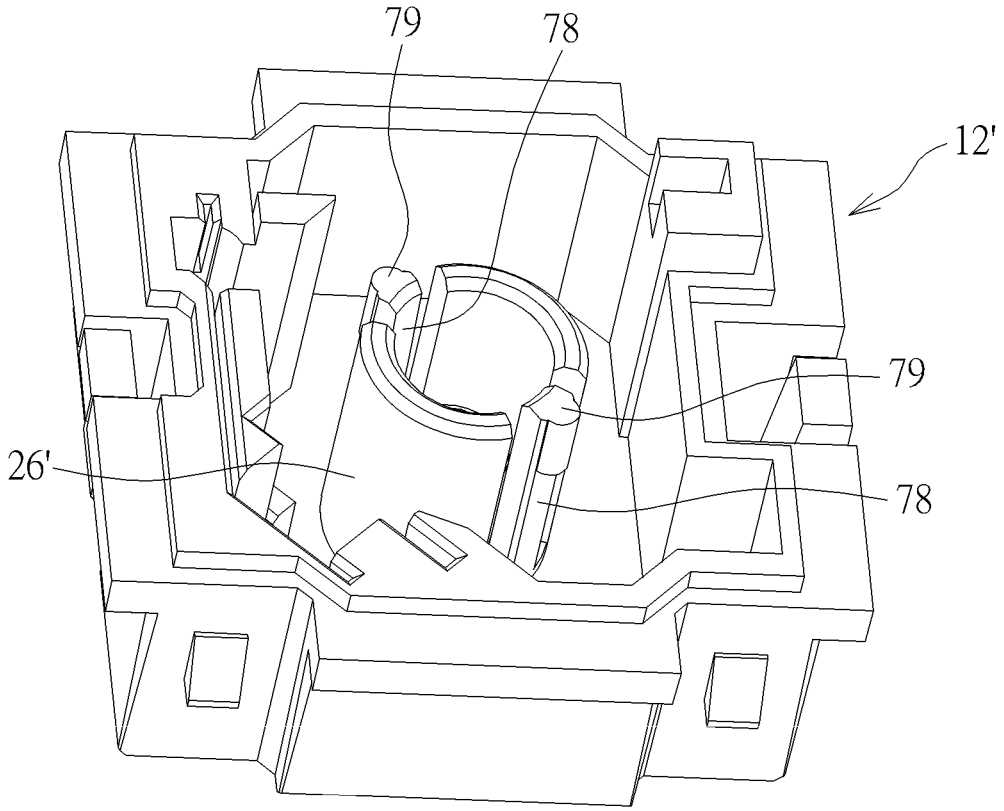
FIG. 25 is a diagram of a base capable of being assembled with the sleeve in FIG. 24.

Please refer to FIG. 24 and FIG. 25. FIG. 24 is an exploded diagram of a cover 18' and a sleeve 20' according to another embodiment of the present invention. FIG. 25 is a diagram of a base 12' capable of being assembled with the sleeve 20' in FIG. 24. Components both mentioned in this embodiment and the aforesaid embodiments represent components with similar structures or functions, and the related description is omitted herein. As shown in FIG. 24 and FIG. 25, at least one limiting rib 74 (two shown in FIG. 24, but not limited thereto) is formed on the cover 18'. The sleeve 20' could have a protruding shaft 46 and a limiting slot 76 corresponding to the limiting rib 74. The base 12' has a pillar 26'. The pillar 26' could have at least one positioning arm 78 (two shown in FIG. 24, but not limited thereto). The sleeve 20' could further have two positioning slots 80, 82. An end of the positioning arm 78 corresponding to the two positioning slots 80, 82 has a protruding point 79 formed thereon.

In such a manner, when the sleeve 20' is located at the high position, the limiting rib 74 is inserted into the limiting slot 76 to make the sleeve 20' not rotate on the pillar 26' relative to the cover 18'. On the other hand, when the sleeve 20' moves from the high position to the low position, the limiting rib 74 is separate from the limiting slot 76 to make the sleeve 20' rotatable on the pillar 26' relative to the cover 18'. In such a manner, this limiting design can efficiently prevent structural jamming of the button switch caused by the user accidentally rotating the sleeve.

Moreover, when the protruding point 79 is engaged with the positioning slot 80, the sleeve 20' is positioned to make the resilient arm 16 abut against the first convex portion 30 at the first position $P_1$. When the protruding point 79 is engaged with the positioning slot 82, the sleeve 20' is positioned to make the resilient arm 16 abut against the second convex portion 34, the second convex portion 66, or the first convex portion 30 at the second position $P_2$. As such, this positioning design can make the user surely aware of whether the sleeve 20' is rotated to a right position.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A button switch connected to a cap, the button switch comprising:

a base having a pillar extending along a Z-axis, the Z-axis, an X-axis and a Y-axis being perpendicular to each other;

a cover disposed on the base;

a flexible acoustic member having a fixing rod and a flexible rod, the fixing rod being fixed to the base;

a sleeve rotatably jacketing the pillar to be movable upward and downward between a high position and a low position along the Z-axis, an upper end of the sleeve passing through the cover to be connected to the cap, the sleeve having an outer annular surface, the outer annular surface having a first convex portion, a first concave portion, a second convex portion, a second concave portion, and a protruding edge located between the second convex portion and the second concave portion;

an upward-force-applying member abutting against the sleeve and the base respectively for driving the sleeve to move away from the base; and a resilient arm adjacent to the pillar, the resilient arm selectively abutting against the first convex portion at a first position or a second position with rotation of the sleeve on the pillar around the Z-axis when the sleeve is located at the high position, the resilient arm moving to a position corresponding to the first concave portion when the sleeve is located at the low position;

wherein when the sleeve rotates to make the resilient arm abut against the first convex portion at the first position, the protruding edge is misaligned with the flexible rod, and the sleeve receives an external force to move downward along the Z-axis, the flexible rod does not need to cross the protruding edge and the resilient arm moves from the first position to the position corresponding to the first concave portion with downward movement of the sleeve;

when the sleeve rotates to make the resilient arm abut against the first convex portion at the second position, the protruding edge is located above the flexible rod, and the sleeve receives the external force to move downward along the Z-axis, the flexible rod needs to cross the protruding edge and the resilient arm moves from the second position to a position corresponding to the second concave portion with downward movement of the sleeve;

when the sleeve moves downward along the Z-axis and deformation of the flexible rod caused by pressing of the protruding edge is not enough to make the flexible rod cross the protruding edge, the flexible rod deforms downward with the protruding edge;

when deformation of the flexible rod is enough to make the flexible rod cross the protruding edge, the flexible rod is released and then moves upward to collide with the cover for making a sound;

when the external force is released, the upward-force-applying member drives the sleeve to move upward relative to the pillar along the Z-axis for making the resilient arm abut against the first convex portion at the first position or the second position.

2. The button switch of claim 1 further comprising:

a contact point opposite to the resilient arm, the contact point and the resilient arm being coupled to a circuit board respectively;

wherein when the sleeve is located at the high position, the resilient arm abuts against the first convex portion at the first position or the second position to cause outward deformation of the resilient arm for making the resilient arm separate from the contact point;

when the sleeve is located at the low position to make the resilient arm move to the position corresponding to the first concave portion, deformation of the resilient arm is reduced to make the resilient arm abut against the contact point.

3. The button switch of claim 1, wherein the pillar has at least one positioning arm, the sleeve further has two positioning slots corresponding to the positioning arm, and a protruding structure is formed on the positioning arm corresponding to the two positioning slots;

wherein when the protruding structure is engaged with one of the two positioning slots, the sleeve is positioned to make the resilient arm abut against the first convex portion at the first position;

when the protruding structure is engaged with the other of the two positioning slots, the sleeve is positioned to make the resilient arm abut against the first convex portion at the second position.

4. The button switch of claim 1 further comprising:

a resilient sheet fixed to the base, the sleeve having two positioning slots corresponding to the resilient sheet, a protruding point being formed on an end of the resilient sheet corresponding to the two positioning slots;

wherein when the protruding point is engaged with one of the two positioning slots, the sleeve is positioned to make the resilient arm abut against the first convex portion at the first position;

when the protruding point is engaged with the other of the two positioning slots, the sleeve is positioned to make the resilient arm abut against the first convex portion at the second position.

5. The button switch of claim 1, wherein a protruding shaft extends from the sleeve toward the cap, a concave slot is formed on the cap corresponding to the protruding shaft, the protruding shaft is inserted into the concave slot to make the cap detachably connected to the sleeve, the protruding shaft and the concave slot are cross-shaped, a cross-shaped end of the protruding shaft has a bevel edge, the cover has a first mark and a second mark, the bevel edge is used for aligning with the first mark to guide the sleeve to rotate to a position where the resilient arm abuts against the first convex portion at the first position, and the bevel edge is used for aligning with the second mark to guide the sleeve to rotate to a position where the resilient arm abuts against the first convex portion at the second position.

6. The button switch of claim 1, wherein the sleeve further has at least one limiting slot, a limiting rib is formed on the cover corresponding to the limiting slot, the limiting rib is inserted into the limiting slot to make the sleeve not rotate on the pillar relative to the cover when the sleeve is located at the high position, and the limiting rib is separate from the limiting slot to make the sleeve rotatable on the pillar relative to the cover when the sleeve moves from the high position to the low position.

7. A button switch connected to a cap, the button switch comprising:

a base having a pillar extending along a Z-axis, the Z-axis, an X-axis and a Y-axis being perpendicular to each other;

a cover disposed on the base;

a resilient arm adjacent to the pillar;

a sleeve rotatably jacketing the pillar to be movable upward and downward between a high position and a low position along the Z-axis, an upper end of the sleeve passing through the cover to be connected to the cap, the sleeve having an outer annular surface, the outer annular surface having a first convex portion, a first concave portion, a second convex portion, a second concave portion, and an arc-shaped bar, the arc-shaped bar extending above the second convex portion but not extending above the first convex portion, the resilient arm selectively abutting against the first convex portion or the second convex portion when the cap is located at the high position; and an upward-force-applying member abutting against the sleeve and the base respectively for driving the sleeve to move away from the base;

wherein when the resilient arm abuts against the second convex portion and the sleeve receives an external force to move downward along the Z-axis, the resilient arm needs to cross the arc-shaped bar with downward movement of the sleeve when the resilient arm moves to a position corresponding to the second concave portion;

when the resilient arm abuts against the first convex portion and the sleeve receives the external force to move downward along the Z-axis, the resilient arm does not need to cross the arc-shaped bar with downward movement of the sleeve when the resilient arm moves to a position corresponding to the first concave portion;

when the external force is released, the upward-force-applying member drives the sleeve to move upward relative to the pillar along the Z-axis for making the resilient arm abut against the first convex portion or the second convex portion.

8. The button switch of claim 7 further comprising:

a contact point opposite to the resilient arm, the contact point and the resilient arm being coupled to a circuit board respectively;

wherein when the sleeve is located at the high position, the resilient arm abuts against the first convex portion or the second convex portion to cause outward deformation of the resilient arm for making the resilient arm separate from the contact point;

when the sleeve is located at the low position to make the resilient arm move to the position corresponding to the first concave portion or the second concave portion, deformation of the resilient arm is reduced to make the resilient arm abut against the contact point.

9. The button switch of claim 7, wherein the pillar has at least one positioning arm, the sleeve further has two positioning slots corresponding to the positioning arm, and a protruding structure is formed on the positioning arm corresponding to the two positioning slots;

wherein when the protruding structure is engaged with one of the two positioning slots, the sleeve is positioned to make the resilient arm abut against the first convex portion;

when the protruding structure is engaged with the other of the two positioning slots, the sleeve is positioned to make the resilient arm abut against the second convex portion.

10. The button switch of claim 7 further comprising:

a resilient sheet fixed to the base, the sleeve having two positioning slots corresponding to the resilient sheet, a protruding point being formed on an end of the resilient sheet corresponding to the two positioning slots;

wherein when the protruding point is engaged with one of the two positioning slots, the sleeve is positioned to make the resilient arm abut against the first convex portion;

when the protruding point is engaged with the other of the two positioning slots, the sleeve is positioned to make the resilient arm abut against the second convex portion.

11. The button switch of claim 7, wherein a protruding shaft extends from the sleeve toward the cap, a concave slot is formed on the cap corresponding to the protruding shaft, the protruding shaft is inserted into the concave slot to make the cap detachably connected to the sleeve, the protruding shaft and the concave slot are cross-shaped, a cross-shaped end of the protruding shaft has a bevel edge, the cover has a first mark and a second mark, the bevel edge is used for aligning with the first mark to guide the sleeve to rotate to a position where the resilient arm abuts against the first convex portion, and the bevel edge is used for aligning with the second mark to guide the sleeve to rotate to a position where the resilient arm abuts against the second convex portion.

12. The button switch of claim 7, wherein the sleeve further has at least one limiting slot, a limiting rib is formed on the cover corresponding to the limiting slot, the limiting rib is inserted into the limiting slot to make the sleeve not rotate on the pillar relative to the cover when the sleeve is located at the high position, and the limiting rib is separate from the limiting slot to make the sleeve rotatable on the pillar relative to the cover when the sleeve moves from the high position to the low position.

13. A button switch connected to a cap, the button switch comprising:

a base having a pillar, a top surface and a protruding block adjacent to the pillar, the pillar protruding from the top surface along a Z-axis, the Z-axis, an X-axis and a Y-axis being perpendicular to each other, the protruding block being higher than the top surface along the Z-axis;

a cover disposed on the base;

a sleeve rotatably jacketing the pillar to be movable upward and downward between a high position and a low position along the Z-axis, an upper end of the sleeve passing through the cover to be connected to the cap, the sleeve having an outer annular surface, the outer annular surface having a first convex portion, a first concave portion, a second convex portion, and a second concave portion, a groove and a bottom surface being formed on a bottom end of the sleeve, the sleeve rotating on the pillar around the Z-axis to make the protruding block selectively located under the groove or the bottom surface;

an upward-force-applying member abutting against the sleeve and the base respectively for driving the sleeve to move away from the base; and a resilient arm adjacent to the pillar, the resilient arm abutting against the first convex portion when the sleeve rotates around the Z-axis to make the protruding block located under the groove, and the resilient arm abutting against the second convex portion when the sleeve rotates around the Z-axis to make the protruding block located under the bottom surface;

wherein when the protruding block is located under the groove and the sleeve receives an external force to move downward along the Z-axis, the resilient arm moves to a position corresponding to the first concave portion until the protruding block is contained in the groove, so that a maximum movable distance of the sleeve along the Z-axis is set as a first travel distance;

when the protruding block is located under the bottom surface and the sleeve receives the external force to move downward along the Z-axis, the resilient arm moves to a position corresponding to the second concave portion until the protruding block abuts against the bottom surface, so that the maximum movable distance of the cap along the Z-axis is set as a second travel distance less than the first travel distance;

when the external force is released, the upward-force-applying member drives the sleeve to move upward relative to the pillar along the Z-axis for making the resilient arm abut against the first convex portion or the second convex portion.

14. The button switch of claim 13 further comprising:

a contact point opposite to the resilient arm, the contact point and the resilient arm being coupled to a circuit board respectively;

wherein when the sleeve is located at the high position, the resilient arm abuts against the first convex portion or the second convex portion to cause outward deformation of the resilient arm for making the resilient arm separate from the contact point;

when the sleeve is located at the low position to make the resilient arm move to the position corresponding to the first concave portion or the second concave portion, deformation of the resilient arm is reduced to make the resilient arm abut against the contact point.

15. The button switch of claim 13, wherein the pillar has at least one positioning arm, the sleeve further has two positioning slots corresponding to the positioning arm, and a protruding structure is formed on the positioning arm corresponding to the two positioning slots;

wherein when the protruding structure is engaged with one of the two positioning slots, the sleeve is positioned to make the resilient arm abut against the first convex portion;

when the protruding structure is engaged with the other of the two positioning slots, the sleeve is positioned to make the resilient arm abut against the second convex portion.

16. The button switch of claim 13 further comprising:

a resilient sheet fixed to the base, the sleeve having two positioning slots corresponding to the resilient sheet, a protruding point being formed on an end of the resilient sheet corresponding to the two positioning slots;

wherein when the protruding point is engaged with one of the two positioning slots, the sleeve is positioned to make the resilient arm abut against the first convex portion;

when the protruding point is engaged with the other of the two positioning slots, the sleeve is positioned to make the resilient arm abut against the second convex portion.

17. The button switch of claim 13, wherein a protruding shaft extends from the sleeve toward the cap, a concave slot is formed on the cap corresponding to the protruding shaft, the protruding shaft is inserted into the concave slot to make the cap detachably connected to the sleeve, the protruding shaft and the concave slot are cross-shaped, a cross-shaped end of the protruding shaft has a bevel edge, the cover has a first mark and a second mark, the bevel edge is used for aligning with the first mark to guide the sleeve to rotate to a position where the resilient arm abuts against the first convex portion, and the bevel edge is used for aligning with the second mark to guide the sleeve to rotate to a position where the resilient arm abuts against the second convex portion.

18. The button switch of claim 13, wherein the sleeve further has at least one limiting slot, a limiting rib is formed on the cover corresponding to the limiting slot, the limiting rib is inserted into the limiting slot to make the sleeve not rotate on the pillar relative to the cover when the sleeve is located at the high position, and the limiting rib is separate from the limiting slot to make the sleeve rotatable on the pillar relative to the cover when the sleeve moves from the high position to the low position.

19. A button switch connected to a cap, the button switch comprising:

a base having a pillar extending along a Z-axis, the Z-axis, an X-axis and a Y-axis being perpendicular to each other;

a cover disposed on the base;

a switch unit adjacent to the pillar, the switch unit having a resilient arm and a contact point opposite to the resilient arm, the switch unit being electrically connected to a circuit board;

a sleeve rotatably jacketing the pillar to be movable upward and downward between a high position and a low position along the Z-axis, an upper end of the sleeve passing through the cover to be connected to the cap, the sleeve having an outer annular surface, the outer annular surface having a first convex portion, a first concave portion, a second convex portion, a second concave portion, a first transition portion, and a second transition portion lower than the first transition portion along the Z-axis, the first convex portion, the first transition portion and the first concave portion being arranged from down to up along the Z-axis, the second convex portion, the second transition portion and the second concave portion being arranged from down to up along the Z-axis, the resilient arm selectively abutting against the first convex portion or the second convex portion when the sleeve is located at the high position; and an upward-force-applying member abutting against the sleeve and the base respectively for driving the sleeve to move away from the base;

wherein when the resilient arm abuts against the first convex portion and the sleeve receives an external force to move downward along the Z-axis, the resilient arm moves to a position corresponding to the first concave portion along the first transition portion to make the resilient arm located at a first triggering position for triggering the contact point;

when the resilient arm abuts against the second convex portion and the sleeve receives the external force to move downward along the Z-axis, the resilient arm moves to a position corresponding to the second concave portion along the second transition portion to make the resilient arm located at a second triggering position lower than the first triggering position along the Z-axis for triggering the contact point;

when the external force is released, the upward-force-applying member drives the sleeve to move upward relative to the pillar along the Z-axis, to make the resilient arm abut against the first convex portion or the second convex portion and be separate from the contact point.

20. The button switch of claim 19, wherein the first triggering position is defined by where the first transition portion and the first concave portion meet, and the second triggering position is defined by where the second transition portion and the second concave portion meet.

21. The button switch of claim 19, wherein the pillar has at least one positioning arm, the sleeve further has two positioning slots corresponding to the positioning arm, and a protruding structure is formed on the positioning arm corresponding to the two positioning slots;

wherein when the protruding structure is engaged with one of the two positioning slots, the sleeve is positioned to make the resilient arm abut against the first convex portion;

when the protruding structure is engaged with the other of the two positioning slots, the sleeve is positioned to make the resilient arm abut against the second convex portion.

22. The button switch of claim 19 further comprising:

a resilient sheet fixed to the base, the sleeve having two positioning slots corresponding to the resilient sheet, a protruding point being formed on an end of the resilient sheet corresponding to the two positioning slots;

wherein when the protruding point is engaged with one of the two positioning slots, the sleeve is positioned to make the resilient arm abut against the first convex portion;

when the protruding point is engaged with the other of the two positioning slots, the sleeve is positioned to make the resilient arm abut against the second convex portion.

23. The button switch of claim 19, wherein a protruding shaft extends from the sleeve toward the cap, a concave slot is formed on the cap corresponding to the protruding shaft, the protruding shaft is inserted into the concave slot to make the cap detachably connected to the sleeve, the protruding shaft and the concave slot are cross-shaped, a cross-shaped end of the protruding shaft has a bevel edge, the cover has a first mark and a second mark, the bevel edge is used for aligning with the first mark to guide the sleeve to rotate to a position where the resilient arm abuts against the first convex portion, and the bevel edge is used for aligning with the second mark to guide the sleeve to rotate to a position where the resilient arm abuts against the second convex portion.

24. The button switch of claim 19, wherein the sleeve further has at least one limiting slot, a limiting rib is formed on the cover corresponding to the limiting slot, the limiting rib is inserted into the limiting slot to make the sleeve not rotate on the pillar relative to the cover when the sleeve is located at the high position, and the limiting rib is separate from the limiting slot to make the sleeve rotatable on the pillar relative to the cover when the sleeve moves from the high position to the low position.

* * * * *